US011670249B2

(12) United States Patent
Ooga

(10) Patent No.: US 11,670,249 B2
(45) Date of Patent: Jun. 6, 2023

(54) METHOD OF CONTROLLING BACKLIGHT OF DISPLAY DEVICE AND DISPLAY DEVICE DETERMINING A DEMANDED LUMINANCE VALUE FOR BACKLIGHT BLOCKS

(71) Applicant: Shanghai Tianma Micro-Electronics Co., Ltd., Shanghai (CN)

(72) Inventor: Kouichi Ooga, Kanagawa (JP)

(73) Assignee: Shanghai Tianma Micro-Electronics Co., Ltd., Shanghai (CN)

( * ) Notice: Subject to any disclaimer, the term of this patent is extended or adjusted under 35 U.S.C. 154(b) by 0 days.

(21) Appl. No.: 17/521,274

(22) Filed: Nov. 8, 2021

(65) Prior Publication Data

US 2022/0148528 A1 May 12, 2022

(30) Foreign Application Priority Data

Nov. 10, 2020 (JP) ..... JP2020-187346
Aug. 6, 2021 (JP) ..... JP2021-129689

(51) Int. Cl.
*G09G 3/34* (2006.01)
*G09G 3/36* (2006.01)

(52) U.S. Cl.
CPC ..... *G09G 3/3426* (2013.01); *G09G 3/36* (2013.01); *G09G 2320/066* (2013.01); *G09G 2320/0626* (2013.01); *G09G 2320/0686* (2013.01); *G09G 2330/021* (2013.01)

(58) Field of Classification Search
CPC ..... G09G 3/2092; G09G 3/2096; G09G 3/34–3426; G09G 3/36; G09G 3/3607; G09G 3/2007; G09G 2320/0233; G09G 2320/0285; G09G 2320/062–066; G09G 2320/0686; G09G 2330/021; G09G 2360/16; G02F 1/1336–133613
See application file for complete search history.

(56) References Cited

U.S. PATENT DOCUMENTS

2010/0020005 A1* 1/2010 Jung ..... G09G 3/3426 345/102
2010/0302133 A1* 12/2010 Liang ..... G09G 3/3426 345/102

(Continued)

FOREIGN PATENT DOCUMENTS

JP 2013-156355 A 8/2013

*Primary Examiner* — Keith L Crawley
(74) *Attorney, Agent, or Firm* — Sughrue Mion, PLLC

(57) ABSTRACT

Disclosed is a method of controlling a backlight for of a display panel. The backlight includes backlight blocks. The display panel includes display region blocks opposite to the backlight blocks in one-to-one correspondence. The method determines, for each of the backlight blocks, a luminance value demanded from each of pixels in display region blocks including a display region block opposite to the backlight block and one or more display region blocks adjacent to the opposite display region block to the backlight block based on a luminance value of the pixel and a weight determined depending on a relation of a location of the pixel and a location of the backlight block. The method determines, for each of the backlight blocks, a highest value among the demanded luminance values for the backlight block to be a luminance value for the backlight block.

8 Claims, 33 Drawing Sheets

(56) References Cited

U.S. PATENT DOCUMENTS

| | | | | |
|---|---|---|---|---|
| 2011/0148941 | A1* | 6/2011 | Kim | G09G 3/3426 345/102 |
| 2011/0169873 | A1* | 7/2011 | Sano | G09G 3/3611 345/102 |
| 2012/0139974 | A1 | 6/2012 | Sakai et al. | |
| 2012/0176419 | A1* | 7/2012 | Otoi | H04N 21/4318 345/102 |
| 2012/0268505 | A1* | 10/2012 | Tani | G09G 5/10 345/694 |
| 2018/0166002 | A1* | 6/2018 | Sako | G02F 1/133 |
| 2021/0304689 | A1* | 9/2021 | Nam | G09G 3/3426 |

* cited by examiner

H_pixnumber = 7

| X(m) (X-COORDINATE) | 0 | 1 | 2 | 3 | 4 | 5 | 6 |
|---|---|---|---|---|---|---|---|
| left_X(m) | 1.0 | 0.83 | 0.67 | 0.50 | 0.33 | 0.17 | 0.0 |
| center_X(m) | 1.0 | 1.0 | 1.0 | 1.0 | 1.0 | 1.0 | 1.0 |
| right_X(m) | 0.0 | 0.17 | 0.33 | 0.50 | 0.67 | 0.83 | 1.0 |

WEIGHTS IN HORIZONTAL DIRECTION

*FIG. 5A*

LUMINANCE DISTRIBUTION IN DISPLAY REGION BLOCK

451

| | | | | | | | |
|---|---|---|---|---|---|---|---|
| row0 | 0 | 0 | 0 | 0 | 0 | 0 | 0 |
| row1 | 0 | 1 | 0 | 0 | 0 | 0 | 0 |
| row2 | 0 | 0 | 0 | 0 | 0 | 0 | 0 |
| row3 | 0 | 0 | 0 | 0 | 0 | 0 | 0 |
| row4 | 0 | 0 | 0 | 0 | 0 | 0 | 0 |
| row5 | 0 | 0 | 0 | 0 | 0 | 0 | 0 |
| row6 | 0 | 0 | 0 | 0 | 0 | 0 | 0 |

Calculate
max_left
max_center
max_right
in each row

| | max_left_row(n) | max_center_row(n) | max_right_row(n) |
|---|---|---|---|
| row(0) | 0 | 0 | 0 |
| row(1) | 0.83 | 1 | 0.17 |
| row(2) | 0 | 0 | 0 |
| row(3) | 0 | 0 | 0 |
| row(4) | 0 | 0 | 0 |
| row(5) | 0 | 0 | 0 |
| row(6) | 0 | 0 | 0 |

DISTRIBUTION OF LARGEST VALUES IN HORIZONTAL DIRECTION

*FIG. 5B*

V_pixnumber = 7

| Yn (Y-COORDINATE) | up_Y(n) | center_Y(n) | down_Y(n) |
|---|---|---|---|
| 0 | 1.0 | 1.0 | 0.0 |
| 1 | 0.83 | 1.0 | 0.17 |
| 2 | 0.67 | 1.0 | 0.33 |
| 3 | 0.50 | 1.0 | 0.50 |
| 4 | 0.33 | 1.0 | 0.67 |
| 5 | 0.17 | 1.0 | 0.83 |
| 6 | 0.0 | 1.0 | 1.0 |

WEIGHTS IN VERTICAL DIRECTION

DISTRIBUTION OF LUMINANCE VALUES DEMANDED FROM DISPLAY REGION BLOCK TO ASSOCIATED BACKLIGHT BLOCKS

| | | |
|---|---|---|
| max_left_up | max_center_up | max_right_up |
| max_left_center | max_center_center | max_right_center |
| max_left_down | max_center_down | max_right_down |

| | | |
|---|---|---|
| 0.69 | 0.83 | 0.14 |
| 0.83 | 1.0 | 0.17 |
| 0.14 | 0.17 | 0.03 |

| | | | | | | |
|---|---|---|---|---|---|---|
| 0 | 0 | 0 | 0 | 0 | 0 | 0 |
| 0 | 0 | 0 | 0 | 0 | 0 | 0 |
| 0 | 0 | 0 | 0 | 0 | 0 | 0 |
| 0 | 0 | 0 | 0 | 0 | 0 | 1 |
| 0 | 0 | 0 | 0 | 0 | 0 | 0 |
| 0 | 0 | 0 | 0 | 0 | 0 | 0 |
| 0 | 0 | 0 | 0 | 0 | 0 | 0 |

| | | |
|---|---|---|
| 0.00 | 0.50 | 0.50 |
| 0.00 | 1.00 | 1.00 |
| 0.00 | 0.50 | 0.50 |

| | | | | | | |
|---|---|---|---|---|---|---|
| 0 | 0 | 0 | 0 | 0 | 0 | 0 |
| 0 | 0 | 0 | 0 | 0 | 1 | 0 |
| 0 | 0 | 0 | 0 | 0 | 0 | 0 |
| 0 | 0 | 0 | 0 | 0 | 0 | 0 |
| 0 | 0 | 0 | 0 | 0 | 0 | 0 |
| 0 | 0 | 0 | 0 | 0 | 0 | 0 |
| 0 | 0 | 0 | 1 | 0 | 0 | 0 |

| | | |
|---|---|---|
| 0.14 | 0.83 | 0.69 |
| 0.50 | 1.00 | 0.83 |
| 0.50 | 1.00 | 0.50 |

LOCATION OF HIGH INTENSITY-LEVEL PIXEL: CLOSE TO UPPER RIGHT CORNER

| | | | | | | |
|---|---|---|---|---|---|---|
| 0 | 0 | 0 | 0 | 0 | 0 | 0 |
| 0 | 0 | 0 | 0 | 0 | 0.5 | 0 |
| 0 | 0 | 0 | 0 | 0 | 0 | 0 |
| 0 | 0 | 0 | 0 | 0 | 0 | 0 |
| 0 | 0 | 0 | 0 | 0 | 0 | 0 |
| 0 | 0 | 0 | 0 | 0 | 0 | 0 |
| 0 | 0 | 0 | 0 | 0 | 0 | 0 |

451

| | | |
|---|---|---|
| 0.07 | 0.42 | 0.35 |
| 0.08 | 0.50 | 0.42 |
| 0.01 | 0.08 | 0.07 |

401

REFLECT INTERMEDIATE INTENSITY LEVEL

*FIG. 20*

FIRST BACKLIGHT REGION 350A

SECOND BACKLIGHT REGION 350B

BACKLIGHT 30

| | | | | | |
|---|---|---|---|---|---|
| B1L 0 | B2L 246 | B3L 2048 | B1R 4095 | B2R 2048 | B3R 0 |
| B4L 0 | B5L 696 | B6L 4095 | B4R 3399 | B5R 1351 | B6R 0 |
| B7L 0 | B8L 450 | B9L 2744 | B7R 2522 | B8R 0 | B9R 0 |

METHOD OF CONTROLLING BACKLIGHT OF DISPLAY DEVICE AND DISPLAY DEVICE DETERMINING A DEMANDED LUMINANCE VALUE FOR BACKLIGHT BLOCKS

CROSS-REFERENCE TO RELATED APPLICATIONS

This non-provisional application claims priority under 35 U.S.C. § 119(a) on Patent Application No. 2020-187346 filed in Japan on Nov. 10, 2020 and Patent Application No. 2021-129689 filed in Japan on Aug. 6, 2021, the entire contents of which are hereby incorporated by reference.

BACKGROUND

This disclosure relates to control of the backlight of a display device.

A technology called local dimming is used to reduce the power consumption of the backlight and improve the contrast ratio in the displayed image. Local dimming divides the light emitting plane of the backlight of a liquid crystal display device into a plurality of blocks and controls whether to decrease the amount of light emission of each block individually depending on the brightness level in the video frame.

For example, in displaying a white window in a full black background, the local dimming controls the backlight so that the region (blocks) opposite to the region to display the white window will emit more light (at higher luminance) and the region (blocks) opposite to the region (blocks) to display the background (in black) will emit less light.

Such control achieves reduction in the power for the backlight, compared to the case where the whole region of the backlight lights at 100% all the time. Furthermore, the increased difference in luminance between the region emitting more light and the region emitting less light provides a higher contrast ratio in the same plane, which improves the display quality. Examples of the technology of local dimming is disclosed in US 2012/0139974 A and JP 2013-156355 A, for example.

SUMMARY

An aspect of this disclosure is a method of controlling a backlight of a display device including a display panel and the backlight. The backlight includes a plurality of backlight blocks. The display panel includes display region blocks opposite to the plurality of backlight blocks in one-to-one correspondence. The method includes for each of the plurality of backlight blocks: determining a luminance value demanded from each of a plurality of pixels in a plurality of display region blocks including a display region block opposite to the backlight block and one or more display region blocks adjacent to the opposite display region block to the backlight block based on a luminance value of the pixel and a weight determined depending on a relation of a location of the pixel and a location of the backlight block; and determining a highest value among the demanded luminance values for the backlight block to be a luminance value for the backlight block.

Another aspect of this disclosure is a display device including: a display panel; a backlight disposed behind the display panel, the backlight including a plurality of backlight blocks; and a controller configured to control luminance values for the plurality of backlight blocks and light emitted from the backlight and transmitted through the display panel. The controller is configured to perform on each of the plurality of backlight blocks: determining a luminance value demanded from each of a plurality of pixels in a plurality of display region blocks including a display region block opposite to the backlight block and one or more display region blocks adjacent to the opposite display region block to the backlight block based on a luminance value of the pixel and a weight determined depending on a relation of a location of the pixel and a location of the backlight block; and determining a highest value among the demanded luminance values for the backlight block to be a luminance value for the backlight block.

It is to be understood that both the foregoing general description and the following detailed description are exemplary and explanatory and are not restrictive of this disclosure.

BRIEF DESCRIPTION OF THE DRAWINGS

FIG. 5A provides weights in the horizontal direction left_X(m), center_X(m), and right_X(m) in the case where the number of pixels disposed in the horizontal direction in a display region block is 7;

FIG. 5B illustrates an example of a method of calculating the largest values max_left_row(n), max_center_row(n), and max_right_row(n);

FIG. 20 illustrates still another example of luminance value distribution in a display region block;

EMBODIMENTS

Figure 1:
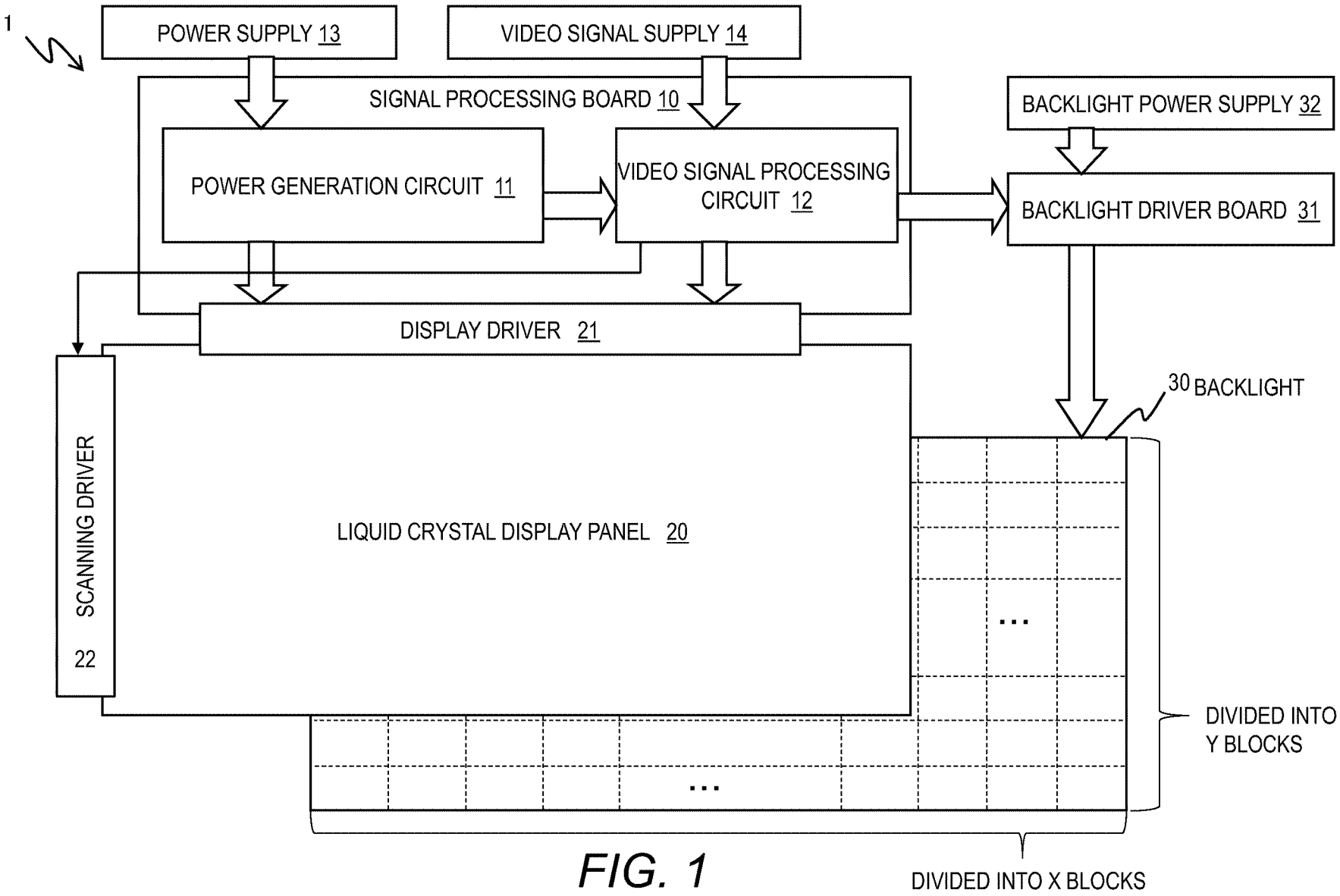
FIG. 1 illustrates a configuration example of a display device in an embodiment.

Hereinafter, embodiments of this disclosure will be described with reference to the accompanying drawings. It should be noted that the embodiments are merely examples to implement this disclosure and are not to limit the technical scope of this disclosure. Elements common to the drawings are denoted by the same reference signs and some elements in the drawings are exaggerated in size or shape for clear understanding of the description.

A display device in an embodiment of this specification includes a display panel for displaying an image by controlling transmission of light and a backlight disposed behind the display panel. The light emitting region of the backlight is divided into a plurality of backlight blocks. The display device determines luminance values demanded from individual pixels within a plurality of display region blocks to a backlight block. The plurality of display region blocks include a display region block opposite to the backlight block and at least one display region block adjacent to the opposite display region block. A demanded luminance value is based on the luminance value of the pixel and a weight determined depending on the relation between the location of the pixel and the location of the backlight block. The display device determines the highest value among the demanded luminance values for the backlight block to be the luminance value for the backlight block. This configuration improves the image quality of a display device that individually controls the luminance of backlight blocks.

Embodiment 1

FIG. 1 illustrates a configuration example of a display device in an embodiment. The display device displays an image by controlling transmission of light emitted from the backlight. FIG. 1 illustrates a configuration example of a liquid crystal display device 1 as an example of a display device. The liquid crystal display device 1 includes a signal processing board 10, a power supply 13, a video signal supply 14, a liquid crystal display panel 20, a display driver 21, a scanning driver 22, a backlight 30, a backlight driver board 31, and a backlight power supply 32. The signal processing board 10 includes a power generation circuit 11 and a video signal processing circuit 12. The signal processing board 10, the display driver 21, the scanning driver 22, and the backlight driving board 31 can be included in the controller of the liquid crystal display device 1.

The liquid crystal display panel 20 is disposed in front (on the side to be viewed by the user) of the backlight 30 and controls the amount of the light emitted from the backlight 30 and transmitted therethrough to display video frames (images) successively input from the external. The power generation circuit 11 can include a DC-DC converter; it generates and supplies electric power for the other circuits to operate. The video signal processing circuit 12 performs processing involved in displaying images, such as generating a signal for displaying an image on the liquid crystal display panel 20 and a signal for controlling the backlight 30. The power supply 13 supplies electric power to the power generation circuit 11. The video signal supply 14 supplies a video signal to the video signal processing circuit 12.

The power generation circuit 11 generates electric power to drive ICs such as the video signal processing circuit 12, the display driver 21, and the scanning driver 22. The display driver 21 and the scanning driver 22 are configured to operate using the power supplied from the power generation circuit 11 to perform their processing.

The display driver 21 generates a data signal from the video signal sent from the video signal processing circuit 12 and supplies the data signal to the liquid crystal display panel 20. The scanning driver 22 selects scanning lines of the liquid crystal display panel 20 one by one in accordance with a timing signal sent from the video signal processing circuit 12. The video signal processing circuit 12 also sends the timing signal to the display driver 21 and the display driver 21 generates a data signal from the received video signal and supplies the data signal to the liquid crystal display panel 20 in accordance with the timing signal.

The video signal processing circuit 12 converts the data arrangement of the video signal input from the external to send it to the display driver 21 and generates and sends a timing signal for the drivers 21 and 22 to operate using the power supplied from the power generation circuit 11. The video signal processing circuit 12 further generates a driving control signal for controlling the driving of the backlight 30 and sends the driving control signal to the backlight driver board 31.

The video signal processing circuit 12 can control the driving of the backlight 30 by controlling the duty value (the percentage in the temporal direction) by PWM or controlling the current value (the percentage with respect to the maximum current value) for a light source. This embodiment employs PWM to control the backlight having light sources of LEDs. The driving control signal for the backlight can be called a PWM signal.

The backlight 30 is a planar light source device disposed behind the liquid crystal display panel 20 to emit light required for the liquid crystal display panel 20 to display an image. The backlight driver board 31 includes a backlight driver circuit and controls the lighting (luminance) of the backlight 30 in accordance with the driving control signal sent from the video signal processing circuit 12. The backlight driver board 31 operates using the power supplied from the backlight power supply 32.

The liquid crystal display device 1 employs local dimming and divides the backlight 30 into X blocks (regions) along the X-axis and Y blocks along the Y-axis, as illustrated in FIG. 1. The liquid crystal display device 1 can individually control the luminance (the amounts of light emission) of the (X×Y) blocks. The liquid crystal display device 1 controls whether to decrease the amount of light emission of each block individually depending on the brightness level in the video frame to reduce the power consumption and improve the contrast ratio.

The video signal processing circuit 12 generates a driving control signal for controlling the luminance of individual blocks of the backlight 30 and sends the driving control signal to the backlight driver board 31. The backlight driver board 31 drives and controls the light sources (for example, LEDs) of the backlight 30 so that the individual blocks light at the luminance values (the amounts of light emission) specified in the driving control signal from the video signal processing circuit 12.

The video signal processing circuit 12 generates a timing signal for the display driver 21 and the scanning driver 22 in accordance with the input timing signal for the video signal and also, successively sends a signal (frame signal) of each video frame in the video signal to the display driver 21. The frame signal can specify the intensity levels of red (R), green (G), and blue (B) of each pixel in a video frame.

The video signal processing circuit 12 further analyzes the video frame, generates a driving control signal for the backlight 30 to illuminate the liquid crystal display panel 20 from its behind based on the analysis result, and sends the driving control signal to the backlight 30. As described above, the liquid crystal display device 1 employs local dimming. The video signal processing circuit 12 determines luminance values (the amounts of light emission) for individual blocks of the backlight 30 based on the analysis result on the video frame.

Figure 2:
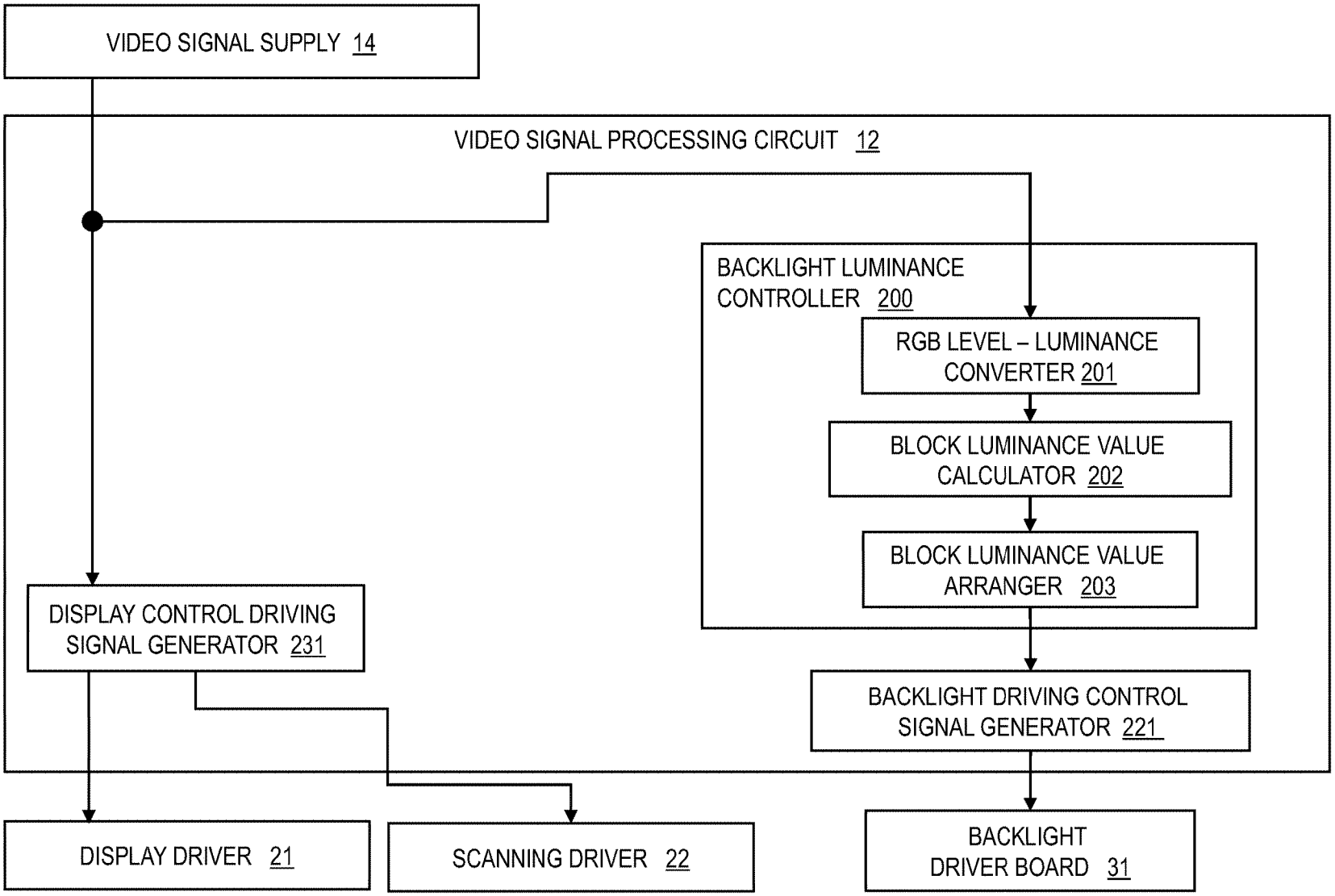
FIG. 2 schematically illustrates an example of the functional configuration of a video signal processing circuit.

Hereinafter, control of the backlight 30 by the video signal processing circuit 12 is described in detail. FIG. 2 schematically illustrates an example of the functional configuration of the video signal processing circuit 12. The video signal processing circuit 12 includes a display control driving signal generator 231, a backlight luminance controller 200, and a backlight driving control signal generator 221. The backlight luminance controller 200 includes an RGB level-luminance converter 201, a block luminance value calculator 202, and a block luminance value arranger 203.

The display control driving signal generator 231 generates signals to be sent to the display driver 21 and the scanning driver 22 from a video signal received from the video signal supply 14. The display control driving signal generator 231 sends the display driver 21 a signal specifying the RGB intensity levels of each pixel in a video frame together with a timing signal and sends the scanning driver 22 the timing signal. The liquid crystal display panel 20 displays an image in accordance with the video frame on its display region.

The RGB level-luminance converter 201, the block luminance value calculator 202, and the block luminance value arranger 203 are circuits for determining the luminance values (the amounts of light emission) for individual blocks of the backlight 30 based on a video frame. The RGB level-luminance converter 201 converts the RGB intensity levels of each pixel specified by the video frame into luminance values (relative luminance values). The luminance value of a pixel to be used to determine the luminance for the backlight is the highest luminance value among the values of red, blue, and green components (also referred to as subpixels) constituting the pixel.

The block luminance value calculator 202 determines luminance values for individual blocks of the backlight 30 based on the luminance values of the pixels of the video frame. Each block of the backlight 30 is opposed to a different part of the display region of the liquid crystal display panel 20. The part of the display region opposite to a block of the backlight 30 is referred to as display region block. The display region block includes a plurality of pixels. To distinguish the block of the backlight 30 from the display region block, the block of the backlight 30 is referred to as backlight block.

The block luminance value calculator 202 determines a luminance value for a backlight block based on the luminance values of the pixels in the display region block opposite to the backlight block and further, the luminance values of the pixels in the display region blocks around the opposite display region block. In the following description, the luminance values of the pixels and the luminance values of the backlight blocks are relative luminance values ranging from 0 to 1. The details of the method for the block luminance value calculator 202 to determine a luminance value for a backlight block will be described later.

The block luminance value arranger 203 generates an array (distribution) of the luminance values for the backlight blocks calculated by the block luminance value calculator 202. In the array, the luminance values are associated with the backlight blocks. The block luminance value arranger 203 sends the generated array of luminance values to the backlight driving control signal generator 221.

The backlight driving control signal generator 221 acquires the luminance values determined for the individual backlight blocks from the backlight luminance controller 200 and generates driving control signals in accordance with the luminance values. The backlight driving control signal generator 221 sends the driving control signals for individual backlight blocks to the backlight driver board 31.

Hereinafter, an example of the method for the backlight luminance controller 200 to determine luminance values for individual backlight blocks is described. The backlight luminance controller 200 determines luminance values for individual backlight blocks based on the luminance values for the pixels of the liquid crystal display panel 20 specified by a video frame. Specifically, the backlight luminance controller 200 determines the luminance value for a backlight block based on the locations of the pixels in the display region block opposite to the backlight block and the display region blocks adjacent to the opposite display region block and the luminance values for those pixels.

Figure 3:
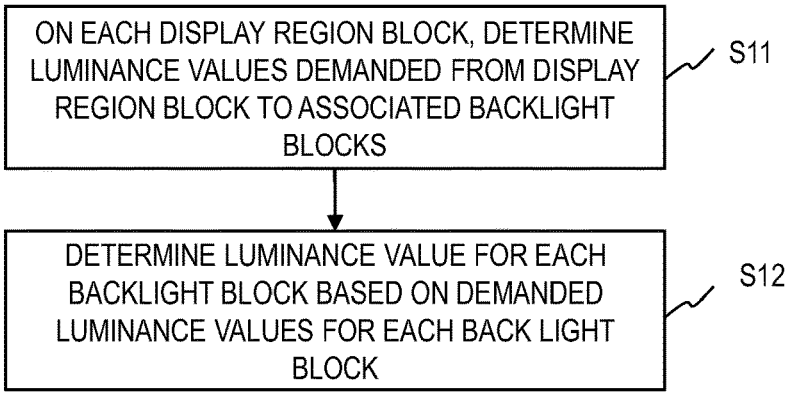
FIG. 3 provides an example of the overall flow of determining a backlight luminance distribution in an embodiment.

FIG. 3 provides an example of the overall flow of determining a backlight luminance distribution in an embodiment. In the following example, the backlight luminance controller 200 determines demanded luminance values (the demanded amounts of light emission) from a display region block to individual backlight blocks associated with the display region block and performs this processing on each of the display region blocks (S11). The backlight luminance controller 200 determines the demanded luminance values for the backlight blocks associated with a display region block based on the pixel luminance distribution (the luminance values and the locations of the pixels) in the display region block.

Next, the backlight luminance controller 200 determines luminance values for the individual backlight blocks based on the demanded luminance values for the backlight blocks (S12). In the following example, the backlight luminance controller 200 determines the highest value among all of the demanded luminance values for a backlight block to be the luminance value for the backlight block.

The general picture of Step S11 to determine the demanded luminance values for the backlight blocks associated with a display region block based on the luminance distribution in the display region block is described with reference to FIGS. 4A to 4E. In this example, one display region block is associated with the backlight block opposite to the display region block and the backlight blocks adjacent to the opposite backlight block. The adjacent backlight blocks include the backlight blocks adjacent horizontally (along the X-axis or a row) and adjacent vertically (along the Y-axis or a column) to the opposite backlight block, and further include the backlight blocks adjacent diagonally to the opposite backlight block. The horizontally and vertically adjacent backlight blocks are examples of the backlight blocks sharing a boundary with the opposite backlight block.

In another example, only a part of the adjacent backlight blocks can be associated with the display region block, or a backlight block farther than the adjacent backlight blocks can be associated with the display region block. In the following example, the backlight blocks and the display region blocks have rectangular shapes and these blocks are disposed in a matrix. Pixels are also represented by rectangles and they are disposed in a matrix within a display region. The shapes and the layout of these are determined by design and not limited to the following example.

Figure 4A:
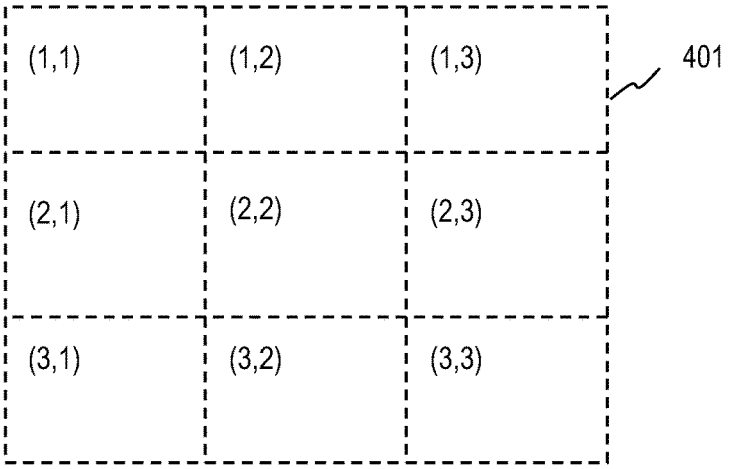
FIG. 4A illustrates backlight blocks associated with one display region block.

FIG. 4A illustrates backlight blocks 401 associated with one display region block. In FIG. 4A, only one of the backlight blocks is provided with a reference sign 401 by way of example. Each backlight block 401 is represented by a rectangle and the numbers in the rectangle are the coordinates (x, y) of the relative location of the backlight block 401. The backlight block 401 at the coordinates (2, 2) is the backlight block opposite to the display region block. In this example, the surrounding blocks are eight backlight blocks 401 adjacent to the backlight block (2, 2).

Figure 4B:
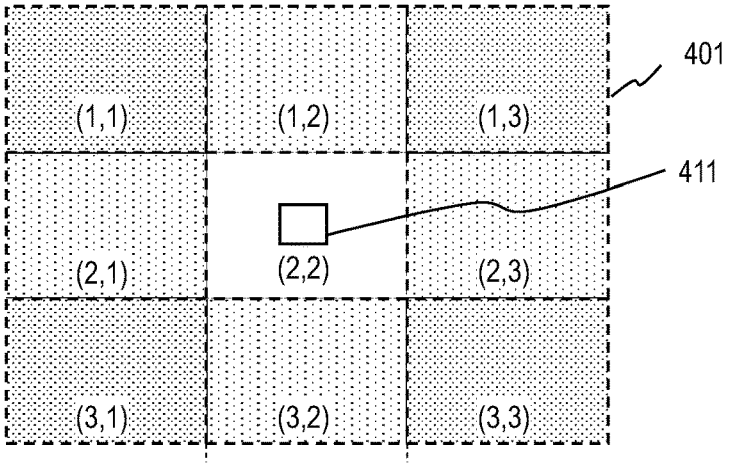
FIG. 4B illustrates an example of the relation between a white region (high intensity-level region consisting of pixels at a luminance value of 1) in a display region block and demanded luminance values for the associated backlight blocks.

FIG. 4B illustrates an example of the relation between a white region (high intensity-level region consisting of pixels at a luminance value of 1) 411 in a display region block and demanded luminance values for the associated backlight blocks 401. The display region block except for the white region 411 is black (at a luminance value of 0).

In the example of FIG. 4B, the white region 411 is located at the center of the backlight block (2, 2). The luminance value for the backlight block (2, 2) is the same 1.0 as the luminance value of the white region 411. The luminance values for the surrounding backlight blocks 401 are determined to be almost equal.

The demanded luminance values for the vertically and horizontally adjacent backlight blocks (1, 2), (2, 1), (2, 3), and (3, 2) are the same and lower than the demanded luminance value for the central backlight block (2, 2) (for example, 0.5). The demanded luminance values for the diagonally adjacent backlight blocks (1, 1), (1, 3), (3, 1), and (3, 3) are the same and lower than the demanded luminance value for the vertically and horizontally adjacent backlight blocks (for example, 0.25).

Figure 4C:
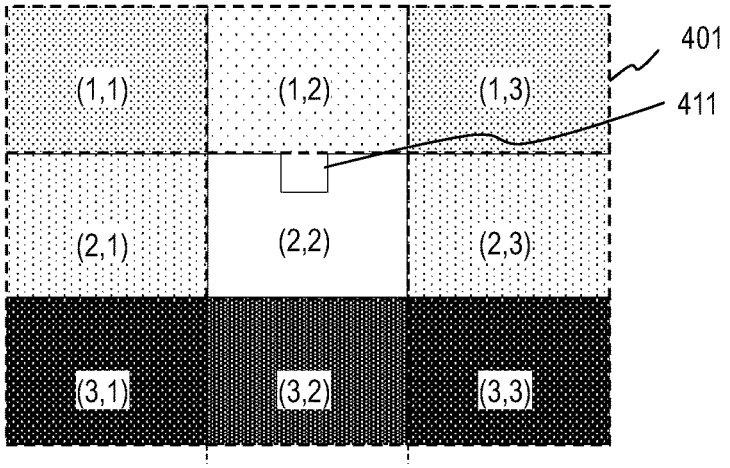
FIG. 4C illustrates another example of the relation between a white region in a display region block and demanded luminance values for the associated backlight blocks.

FIG. 4C illustrates another example of the relation between a white region 411 in a display region block and demanded luminance values for the associated backlight blocks 401. The white region 411 is located at the upper center of the display region block having the same shape and located at the same in-plane position as the backlight block (2, 2). Compared to the example of FIG. 4B, the luminance values for the backlight blocks (1, 1), (1, 2), and (1, 3) are high and the luminance values for the backlight blocks (3, 1), (3, 2), and (3, 3) are low.

In the case where the white region 411 is located at the lower center of the display region block, opposite control is performed. Specifically, the luminance values for the backlight blocks (1, 1), (1, 2), and (1, 3) are low and the luminance values for the backlight blocks (3, 1), (3, 2), and (3, 3) are high, compared to the example of FIG. 4B.

Figure 4D:
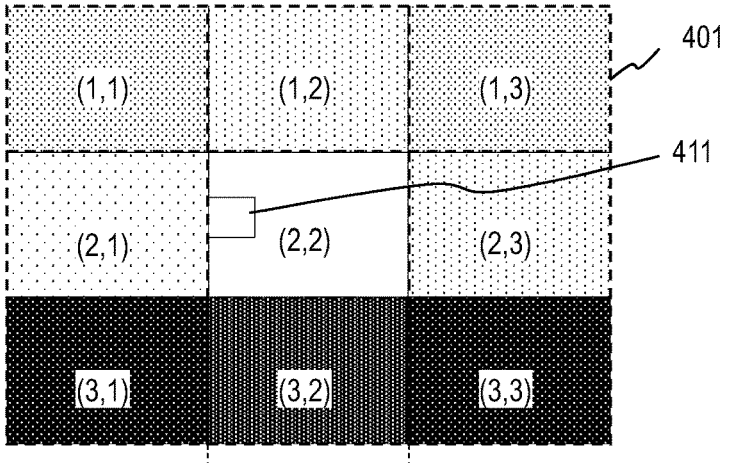
FIG. 4D illustrates still another example of the relation between a white region in a display region block and demanded luminance values for the associated backlight blocks.

FIG. 4D illustrates still another example of the relation between a white region 411 in a display region block and demanded luminance values for the associated backlight blocks 401. The white region 411 is located at the center left of the display region block. Compared to the example of FIG. 4B, the luminance values for the backlight blocks (1, 1), (2, 1), and (3, 1) are high and the luminance values for the backlight blocks (1, 3), (2, 3), and (3, 3) are low.

In the case where the white region 411 is located at the center right of the display region block, opposite control is performed. Specifically, the luminance values for the backlight blocks (1, 1), (2, 1), and (3, 1) are low and the luminance values for the backlight blocks (1, 3), (2, 3), and (3, 3) are high, compared to the example of FIG. 4B.

Figure 4E:
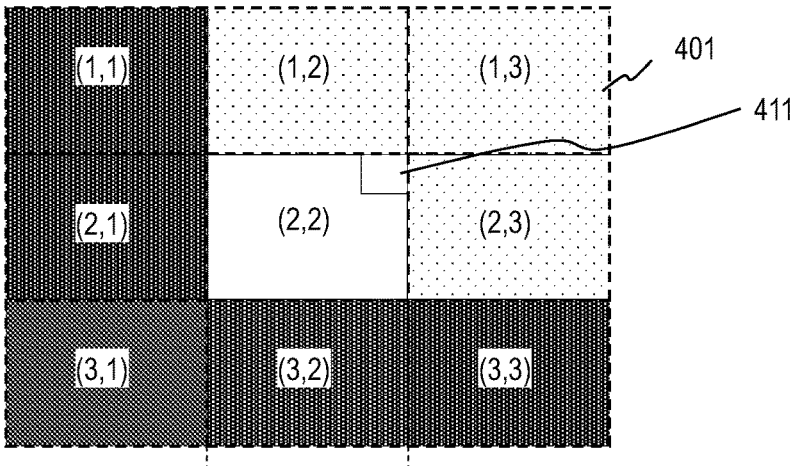
FIG. 4E illustrates still another example of the relation between a white region in a display region block and demanded luminance values for the associated backlight blocks.

FIG. 4E illustrates still another example of the relation between a white region 411 in a display region block and demanded luminance values for the associated backlight blocks 401. The white region 411 is located at the upper right of the display region block. Compared to the example of FIG. 4B, the luminance values for the backlight blocks (1, 2), (1, 3), and (2, 3) are high and the luminance values for the backlight blocks (1, 1), (2, 1), (3, 1,), (3, 2), and (3, 3) are low.

In the case where the white region 411 is located at the lower right, upper left, or lower left of the display region block, the backlight luminance controller 200 assigns a higher luminance value to the backlight blocks close to the white region 411 and assigns a lower luminance value to the backlight blocks far from the white region 411, like in the case of FIG. 4E.

Hereinafter, an example of the method of determining demanded luminance values for backlight blocks based on the luminance distribution in a display region block (S11) is specifically described. The following method is merely an example; a different method can be used to determine the luminance values for the backlight blocks. The following example determines luminance values demanded from a display region block to the backlight block opposite to the display region block and the eight adjacent backlight blocks surrounding the opposite backlight block, as illustrated in the foregoing examples.

First, the backlight block luminance controller 200 calculates weight coefficients (hereinafter, simply referred to as weights) in the horizontal direction to be assigned to the pixels in the display region block. The weights to be calculated are the weights to calculate demanded luminance values for the backlight blocks located on the left side, in the same column (center), and on the right side of the display region block.

The weight left_X(m) for the left side, the weight center_X(m) for the center, and the weight right_X(m) for the right side can be calculated by the following formulae:

$$\text{left_}X(m)=\{(H\text{_pixnumber}-1)-X(m)\}/(H\text{_pixnumber}-1);$$

$$\text{center_}X(m)=1.0;\ \text{and}$$

$$\text{right_}X(m)=X(m)/(H\text{_pixnumber}-1).$$

In the foregoing formulae, X(m) represents the X-coordinate (the coordinate in the horizontal direction) of the pixel in the display region block and H_pixnumber represents the number of pixels disposed in the horizontal direction (along the X-axis) in the display region block.

FIG. 5A provides the weights in the horizontal direction left_X(m), center_X(m), and right_X(m) in the case where the number of pixels disposed in the horizontal direction in the display region block is 7. The X-coordinate m is an integer ranging from 0 to 6.

The weight left_X(m) is for the backlight blocks (1, 1), (2, 1), and (3, 1) in FIG. 4A. The value of the weight left_X(m) decreases from the left to the right. The weight center_X(m) is for the backlight blocks (1, 2), (2, 2), and (3, 2) in FIG. 4A. The value of the weight center_X(m) is fixed at 1.0. The weight right_X(m) is for the backlight blocks (1, 3), (2, 3), and (3, 3) in FIG. 4A. The value of the weight right_X(m) decreases from the right to the left. As noted from this example, the weights in the horizontal direction can be expressed by decreasing functions with respect to the distance between the pixel and the backlight block.

Next, the backlight luminance controller 200 calculates products of the luminance value of each pixel in the display region block and the above-described three weights. Furthermore, the backlight luminance controller 200 determines the largest value among the products of the luminance values of the pixels in a pixel row (a group of pixels aligned along the X-axis) and a weight and repeats this determination on every combination of a pixel row and a weight.

The largest value among the products of the weight left_X(m) and the pixel luminance value L(m) in a pixel row n is expressed as max_left_row(n). The largest value among the products of the weight center_X(m) and the pixel luminance value L(m) in the pixel row n is expressed as max_center_row(n). The largest value among the products of the weight right_X(m) and the pixel luminance value L(m) in the pixel row n is expressed as max_right_row(n). In these expressions, n is an integer ranging from 0 to the value obtained by deducting 1 from the number of pixel rows in the display region block.

The largest values max_left_row(n), max_center_row(n), and max_right_row(n) can be calculated by the following formulae:

$$\text{max_left_row}(n)=\text{MAX}\{L(m)\times\text{left_}X(m)\};$$

$$\text{max_center_row}(n)=\text{MAX}\{L(m)\times\text{center_}X(m)\};\ \text{and}$$

$$\text{max_right_row}(n)=\text{MAX}\{L(m)\times\text{right_}X(m)\}.$$

FIG. 5B illustrates an example of the method of calculating the largest values max_left_row(n), max_center_row(n), and max_right_row(n). In the example of pixel luminance distribution in a display region block 451, only the pixel (1, 1) lights at a luminance value of 1.0 and the luminance values of the other pixels are 0. The largest values max_left_row(n), max_center_row(n), and max_right_row(n) are calculated based on this pixel luminance distribution in the display region block 451 and the weights in the horizontal direction in FIG. 5A.

As shown in FIG. 5B, the largest values in the pixel rows except for the pixel row row(1) are 0. The largest values max_left_row(n), max_center_row(n), and max_right_row(n) in the pixel row row(1) are the values obtained by multiplying the luminance value of 1 by the weights in the case where the X-coordinate is 1.

Next, the backlight luminance controller 200 calculates the weights in the vertical direction to be assigned to the pixels in the display region block. The weights to be calculated are the weights for the demanded luminance values for the backlight blocks located on the upper side, in the same row (center), and on the lower side of the display region block.

The weight up_Y(n) for the upper side, the weight center_Y(n) for the center, and the weight down_Y(n) for the lower side can be calculated by the following formulae:

$$\text{up_}Y(n)=\{(V\text{_pixnumber}-1)-Y(n)\}/(V\text{_pixnumber}-1);$$

$$\text{center_}Y(n)=1.0;\ \text{and}$$

$$\text{down_}Y(n)=Y(n)/(V\text{_pixnumber}-1).$$

In the foregoing formulae, Y(n) represents the Y-coordinate (the coordinate in the vertical direction) of the pixel in the display region block and V_pixnumber represents the number of pixels disposed in the vertical direction (along the Y-axis) in the display region block.

Figures 5C, 5D:
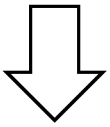
FIG. 5C provides weights in the vertical direction up_Y(n), center_Y(n), and down_Y(n) in the case where the number of pixels disposed in the vertical direction in a display region is 7.
FIG. 5D provides an example of distribution of luminance values demanded from a display region block to backlight blocks.

FIG. 5C provides the weights in the vertical direction up_Y(n), center_Y(n), and down_Y(n) in the case where the number of pixels disposed in the vertical direction in the display region block is 7. The Y-coordinate n is an integer ranging from 0 to 6.

The weight up_Y(n) is for the backlight blocks (1, 1), (1, 2), and (1, 3) in FIG. 4A. The value of the weight up_Y(n) decreases from the top to the bottom. The weight center_Y(n) is for the backlight blocks (2, 1), (2, 2), and (2, 3) in FIG. 4A. The value of the weight center_Y(n) is fixed at 1.0. The weight down_Y(n) is for the backlight blocks (3, 1), (3, 2), and (3, 3) in FIG. 4A. The value of the weight down_Y(n) decreases from the bottom to the top. As noted from this example, the weights in the vertical direction can be expressed by decreasing functions with respect to the distance between the pixel and the backlight block.

Next, the backlight luminance controller 200 calculates the products of the largest values max_left_row(n), max_center_row(n), and max_right_row(n) and the weights in the vertical direction. Furthermore, the backlight luminance controller 200 determines the largest value in each of the nine combinations of the different horizontal locations and the different vertical locations. The nine combinations correspond to the nine backlight blocks in FIG. 4A. These largest values constitute a distribution of demanded luminance values for the backlight blocks associated with the display region block.

FIG. 5D provides an example of distribution of luminance values demanded from a display region block to backlight blocks. The distribution of demanded luminance values has nine sections of max_left_up, max_center_up, max_right_up, max_left_center, max_center_center, max_right_center, max_left_down, max_center_down, and max_right_down. These sections correspond to the backlight blocks (1, 1), (1, 2), (1, 3), (2, 1), (2, 2), (2, 3), (3, 1), (3, 2), and (3, 3) in FIG. 4A.

The foregoing demanded luminance values can be calculated by the following formulae:

$$\text{max_left_up}=\text{MAX}\{\text{max_left_row}(n)\times\text{up_}Y(n)\};$$

$$\text{max_left_center}=\text{MAX}\{\text{max_left_row}(n)\times\text{center_}Y(n)\};$$

$$\text{max_left_down}=\text{MAX}\{\text{max_left_row}(n)\times\text{down_}Y(n)\};$$

$$\text{max_center_up}=\text{MAX}\{\text{max_center_row}(n)\times\text{up_}Y(n)\};$$

$$\text{max_center_center}=\text{MAX}\{\text{max_center_row}(n)\times\text{center_}Y(n)\};$$

$$\text{max_center_down}=\text{MAX}\{\text{max_center_row}(n)\times\text{down_}Y(n)\};$$

$$\text{max_right_up}=\text{MAX}\{\text{max_right_row}(n)\times\text{up_}Y(n)\};$$

$$\text{max_right_center}=\text{MAX}\{\text{max_right_row}(n)\times\text{center_}Y(n)\};\text{ and}$$

$$\text{max_right_down}=\text{MAX}\{\text{max_right_row}(n)\times\text{down_}Y(n)\}.$$

FIG. 5D further provides a distribution of demanded luminance values of the example described with reference to FIGS. 5A to 5C. The values are calculated as follows.

$$\text{max_left_up}=\text{MAX}\{0\times1.0,\ 0.83\times0.83,\ 0\times0.67,\ 0\times0.50,\ 0\times0.33,\ 0\times0.17,\ 0\times0.0\}=0.83\times0.83=0.69$$

$$\text{max_left_center}=\text{MAX}\{0\times1.0,\ 0.83\times1.0,\ 0\times1.0,\ 0\times1.0,\ 0\times1.0,\ 0\times1.0,\ 0\times1.0\}=0.83\times1.0=0.83$$

$$\text{max_left_down}=\text{MAX}\{0\times0.0,\ 0.83\times0.17,\ 0\times0.33,\ 0\times0.50,\ 0\times0.67,\ 0\times0.83,\ 0\times1.0\}=0.83\times0.17=0.14$$

$$\text{max_center_up}=\text{MAX}\{0\times1.0,\ 1\times0.83,\ 0\times0.67,\ 0\times0.50,\ 0\times0.33,\ 0\times0.17,\ 0\times0.0\}=1\times0.83=0.83$$

$$\text{max_center_center}=\text{MAX}\{0\times1.0,\ 1\times1.0,\ 0\times1.0,\ 0\times1.0,\ 0\times1.0,\ 0\times1.0,\ 0\times1.0\}=1\times1.0=1.0$$

-continued $$\text{max_center_down}=\text{MAX}\{0\times0.0,\ 1\times0.17,\ 0\times0.33,\ 0\times0.50,\ 0\times0.67,\ 0\times0.83,\ 0\times1.0\}=1\times0.17=0.17$$

$$\text{max_right_up}=\text{MAX}\{0\times1.0,\ 0.17\times0.83,\ 0\times0.67,\ 0\times0.50,\ 0\times0.33,\ 0\times0.17,\ 0\times0.0\}=0.17\times0.83=0.14$$

$$\text{max_right_center}=\text{MAX}\{0\times1.0,\ 0.17\times1.0,\ 0\times1.0,\ 0\times1.0,\ 0\times1.0,\ 0\times1.0,\ 0\times1.0\}=0.17\times1.0=0.17$$

$$\text{max_right_down}=\text{MAX}\{0\times0.0,\ 0.17\times0.17,\ 0\times0.33,\ 0\times0.50,\ 0\times0.67,\ 0\times0.83,\ 0\times1.0\}=0.17\times0.17=0.03$$

As described above, the backlight luminance controller 200 calculates luminance values demanded from a display region block to individual backlight blocks associated therewith. For each pixel in a display region, the weight to be assigned from the pixel to a backlight block is expressed by the product of a horizontal weight and a vertical weight determined depending on the location of the pixel. The largest value among the products of the luminance values of the pixels and the weights of the pixels for a backlight block is the luminance value demanded from the display region block to the backlight block. For example, the weights of the pixels in a display region block for the opposite backlight block are 1. Accordingly, the demanded luminance value for the backlight block opposite to the display region block is the same as the highest luminance value in the display region block.

The foregoing example calculates the weights of each pixel in a display region block based on the location of the pixel and determines the luminance values demanded from the display region block to the backlight blocks from the calculated weights and the luminance values of the pixels. Compared to the configuration such that the weights of each pixel for the associated backlight blocks are held in advance, the required memory size can be much small.

The weights of all pixels for every backlight block can be preset. The method of calculating the highest luminance value demanded from a display region block to a backlight block is not limited to the foregoing example. For example, the method can first determine the highest value in each vertical pixel column and subsequently multiply the highest value by the weights in the horizontal direction.

Next, an example of the method of determining a luminance value for a backlight block based on the luminance values demanded from a plurality of display region blocks to the backlight block (S12) is described. The backlight luminance controller 200 determines the highest value among all demanded luminance values for one backlight block to be the luminance value for the backlight block.

Figure 6:
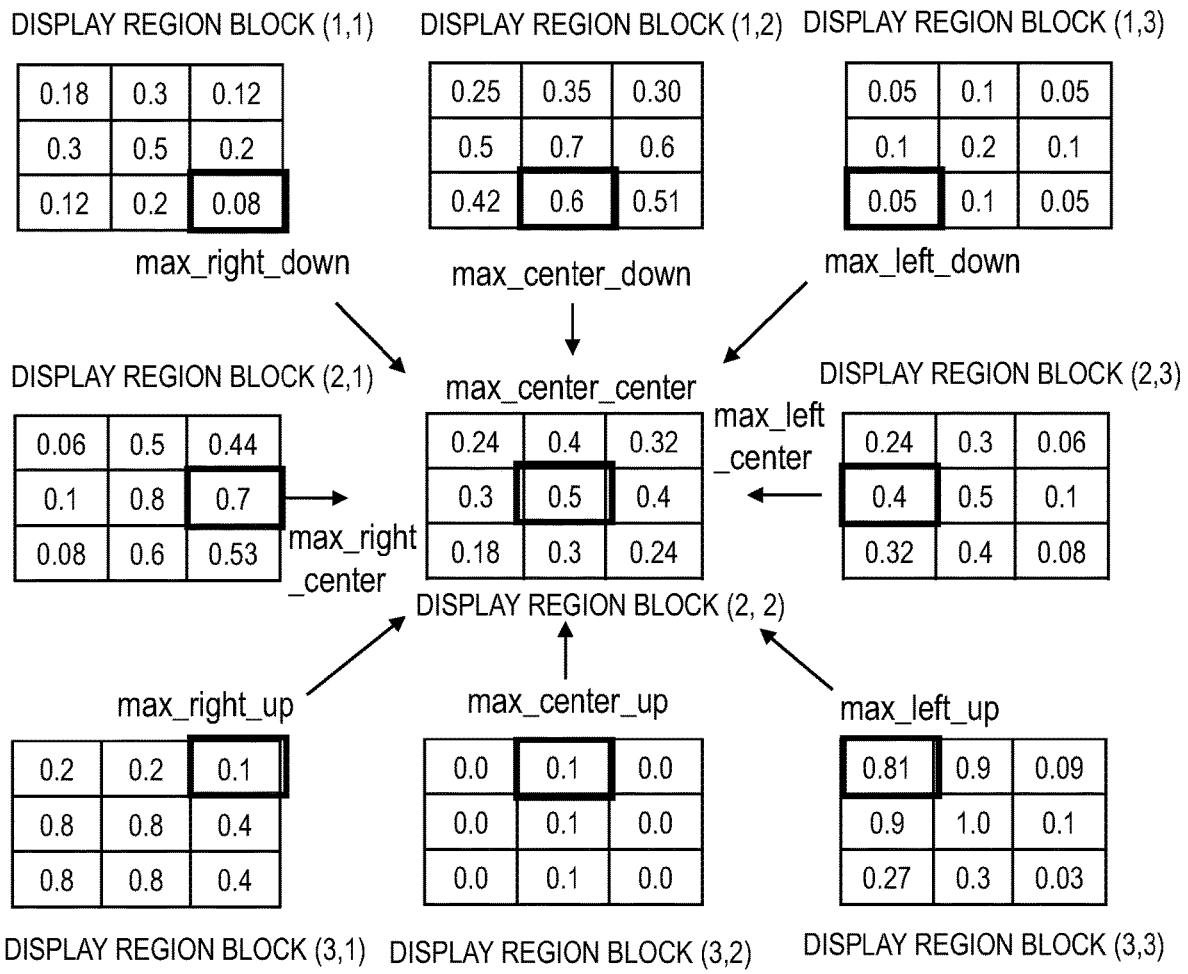
FIG. 6 provides examples of luminance values demanded from a plurality of display region blocks to one backlight block.

FIG. 6 provides examples of luminance values demanded from a plurality of display region blocks to one backlight block. The display region block (2, 2) is opposite to this backlight block. The display region block (x, y) represents a display region block located at relative coordinates (x, y).

The luminance value demanded from the display region block (1, 1) to the backlight block is max_right_down=0.08. The luminance value demanded from the display region block (1, 2) to the backlight block is max_center_down=0.6. The luminance value demanded from the display region block (1, 3) to the backlight block is max_left_down=0.05.

The luminance value demanded from the display region block (2, 1) to the backlight block is max_right_center=0.7. The luminance value demanded from the display region block (2, 2) to the backlight block is max_center_center=0.5. The luminance value demanded from the display region block (2, 3) to the backlight block is max_left_center=0.4.

The luminance value demanded from the display region block (3, 1) to the backlight block is max_right_up=0.1. The luminance value demanded from the display region block (3, 2) to the backlight block is max_center_up=0.1. The luminance value demanded from the display region block (3, 3) to the backlight block is max_left_up=0.81.

The backlight luminance controller 200 determines the highest value among these demanded luminance values to be the luminance value for this backlight block. The highest value among these examples is max_left_up=0.81.

In the configuration example in FIG. 6, the backlight blocks are disposed in a matrix. Each backlight block is associated with the display region block opposite thereto and the display region blocks horizontally, vertically, and diagonally adjacent thereto. In another configuration example, each backlight block can be associated with only a part of these display region blocks surrounding the backlight block.

Figure 7:
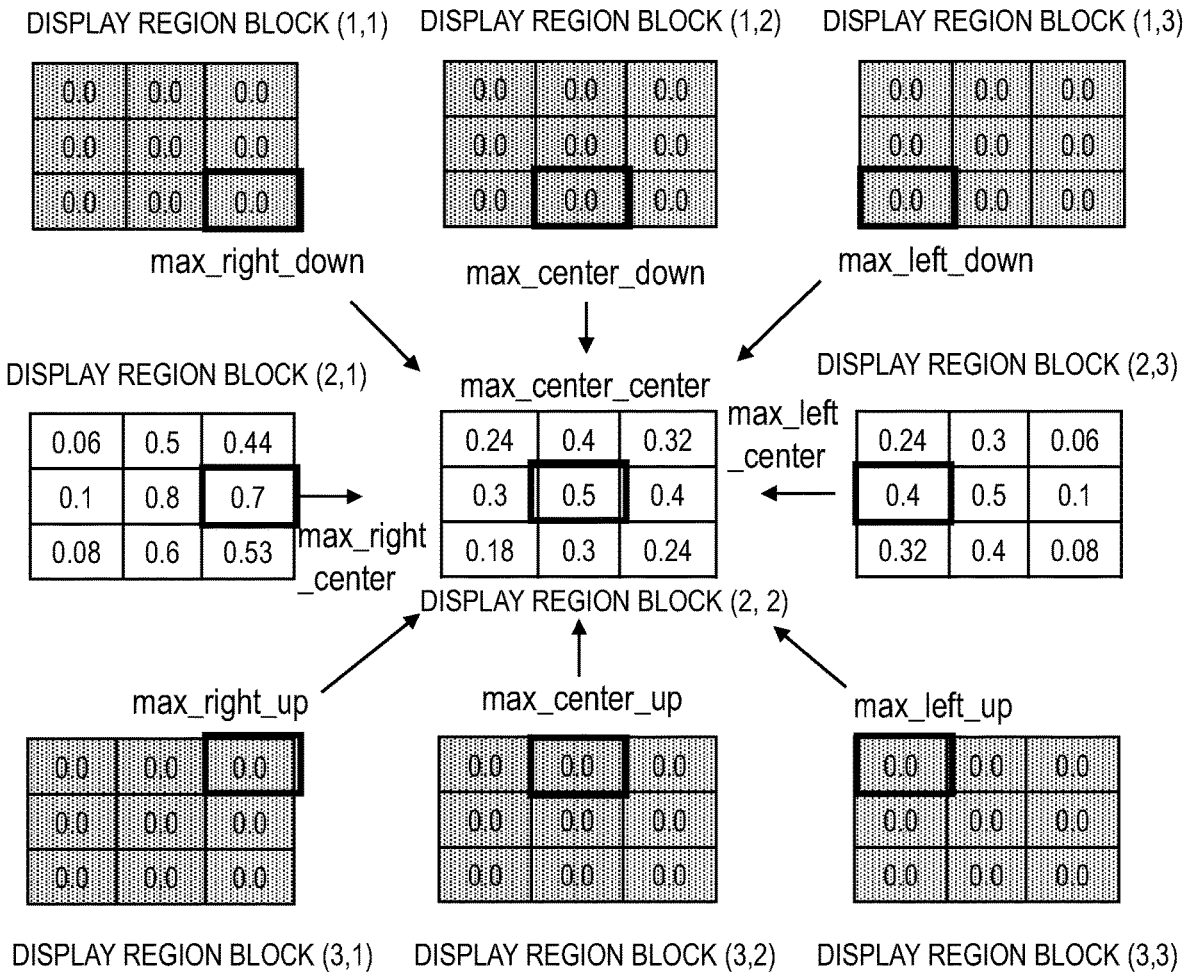
FIG. 7 illustrates an example where the backlight is composed of backlight blocks aligned horizontally (laterally in FIG. 7)

FIG. 7 illustrates an example where the backlight is composed of backlight blocks aligned horizontally (laterally in FIG. 7). The backlight block is associated with the display region block opposite thereto and the display region blocks horizontally adjacent thereto. In FIG. 7, only the display region blocks (2, 1), (2, 2), and (2, 3) exist and the other display region blocks do not exist. Accordingly, the demanded luminance values for the other display region blocks are all 0. The luminance value for the backlight block in the example of FIG. 7 can be determined by the calculation described with reference to FIGS. 5A to 6.

In the example of FIG. 7, the luminance value demanded from the display region block (2, 1) to the backlight block is max_right_center=0.7. The luminance value demanded from the display region block (2, 2) to the backlight block is max_center_center=0.5. The luminance value demanded from the display region block (2, 3) to the backlight block is max_left_center=0.4. The highest value among these values is max_right_center=0.7 and therefore, the luminance value for the backlight block is determined to be 0.7.

Figure 8:
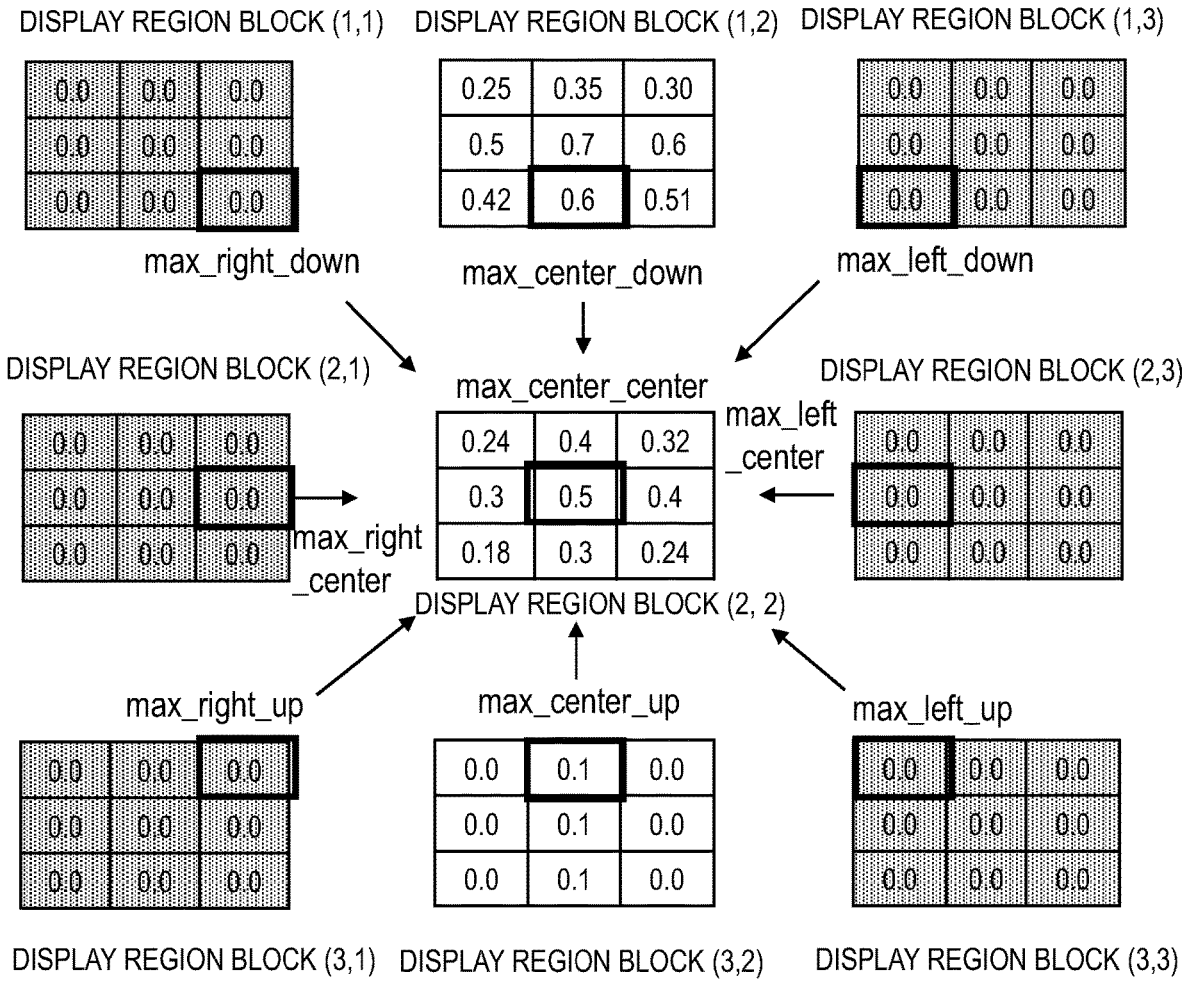
FIG. 8 illustrates an example where the backlight is composed of backlight blocks aligned vertically (longitudinally in FIG. 8)

FIG. 8 illustrates an example where the backlight is composed of backlight blocks aligned vertically (longitudinally in FIG. 8). The backlight block is associated with the display region block opposite thereto and the display region blocks vertically adjacent thereto. In FIG. 8, only the display region blocks (1, 2), (2, 2), and (3, 2) exist and the other display region blocks do not exist. Accordingly, the luminance values demanded from the other display region blocks are all 0. The luminance value for the backlight block in the example of FIG. 8 can be determined by the calculation described with reference to FIGS. 5A to 6.

In the example of FIG. 8, the luminance value demanded from the display region block (1, 2) to the backlight block is max_center_down=0.6. The luminance value demanded from the display region block (2, 2) to the backlight block is max_center_center=0.5. The luminance value demanded from the display region block (3, 2) to the backlight block is max_center_up=0.1. The highest value among these values is max_center_down=0.6 and therefore, the luminance value for the backlight block is determined to be 0.6.

Figure 9:
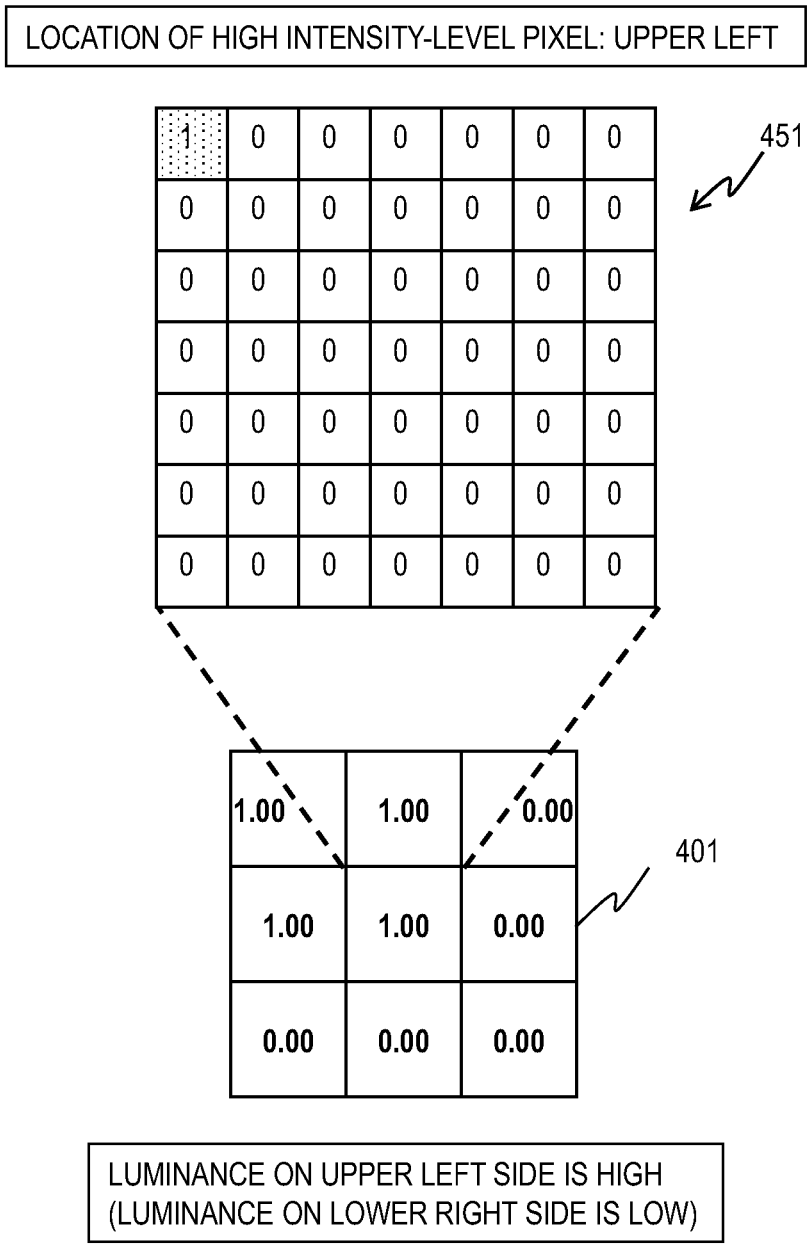
FIG. 9 illustrates an example of pixel luminance distribution in one display region block and examples of demanded luminance values for the associated backlight blocks.

Hereinafter, examples of luminance values demanded from one display region block to the backlight blocks associated therewith are described. FIG. 9 illustrates an example of pixel luminance distribution in one display region block 451 and demanded luminance values for the associated backlight blocks 401. The display region block 451 is associated with the opposite backlight block located at the center and the eight backlight blocks surrounding the opposite backlight block.

In the example of FIG. 9, the display region block 451 is opposed to the central backlight block. In the display region block 451, the pixel at the upper left corner is assigned a luminance value of 1.0 and the other pixels are assigned a luminance value of 0. In accordance with this luminance value distribution, the demanded luminance values for the upper left backlight blocks are higher and the demanded luminance values for the lower right backlight blocks are lower.

Figure 10:
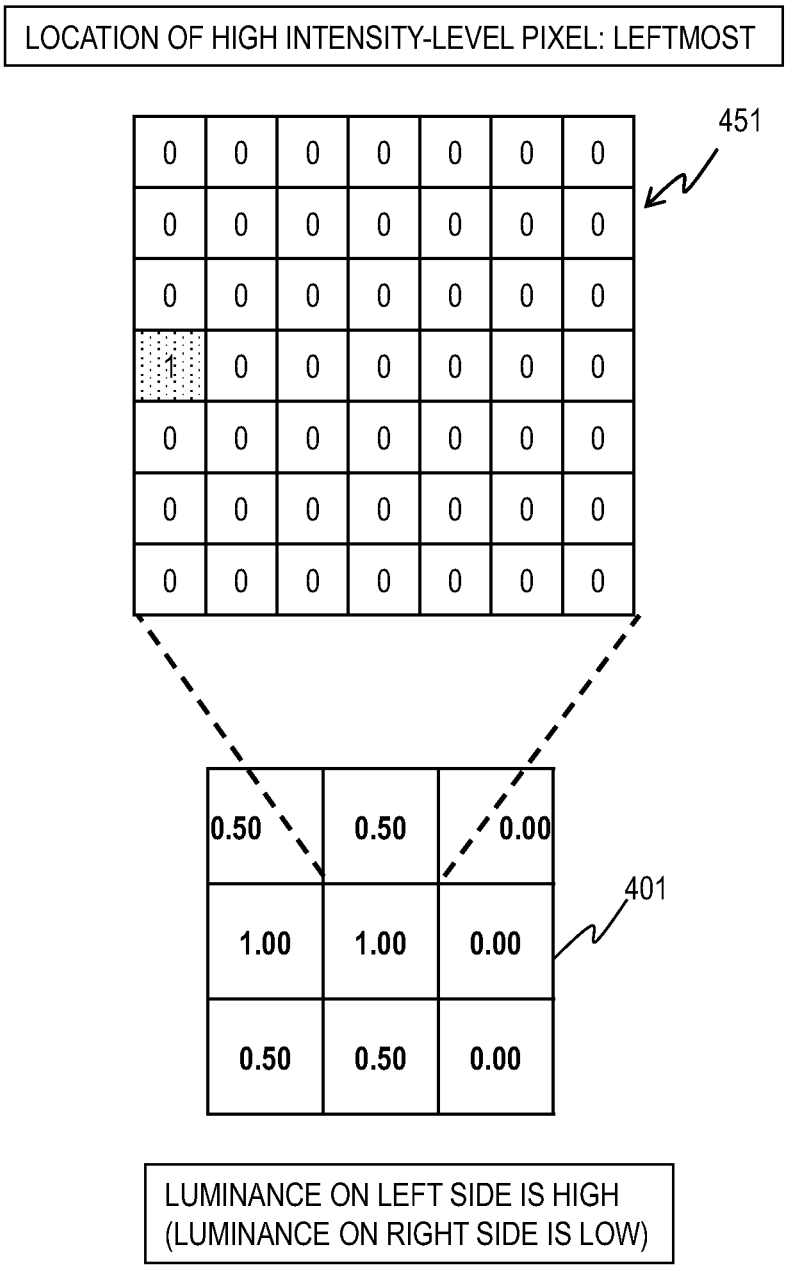
FIG. 10 illustrates another example of luminance value distribution in a display region block.

FIG. 10 illustrates another example of luminance value distribution in the display region block 451. In the display region block 451, the pixel at the center in the leftmost column is assigned a luminance value of 1.0 and the other pixels are assigned a luminance value of 0. In accordance with this luminance value distribution, the demanded luminance values for the backlight blocks on the left are higher and the demanded luminance values for the backlight blocks on the right are lower.

Figure 11:
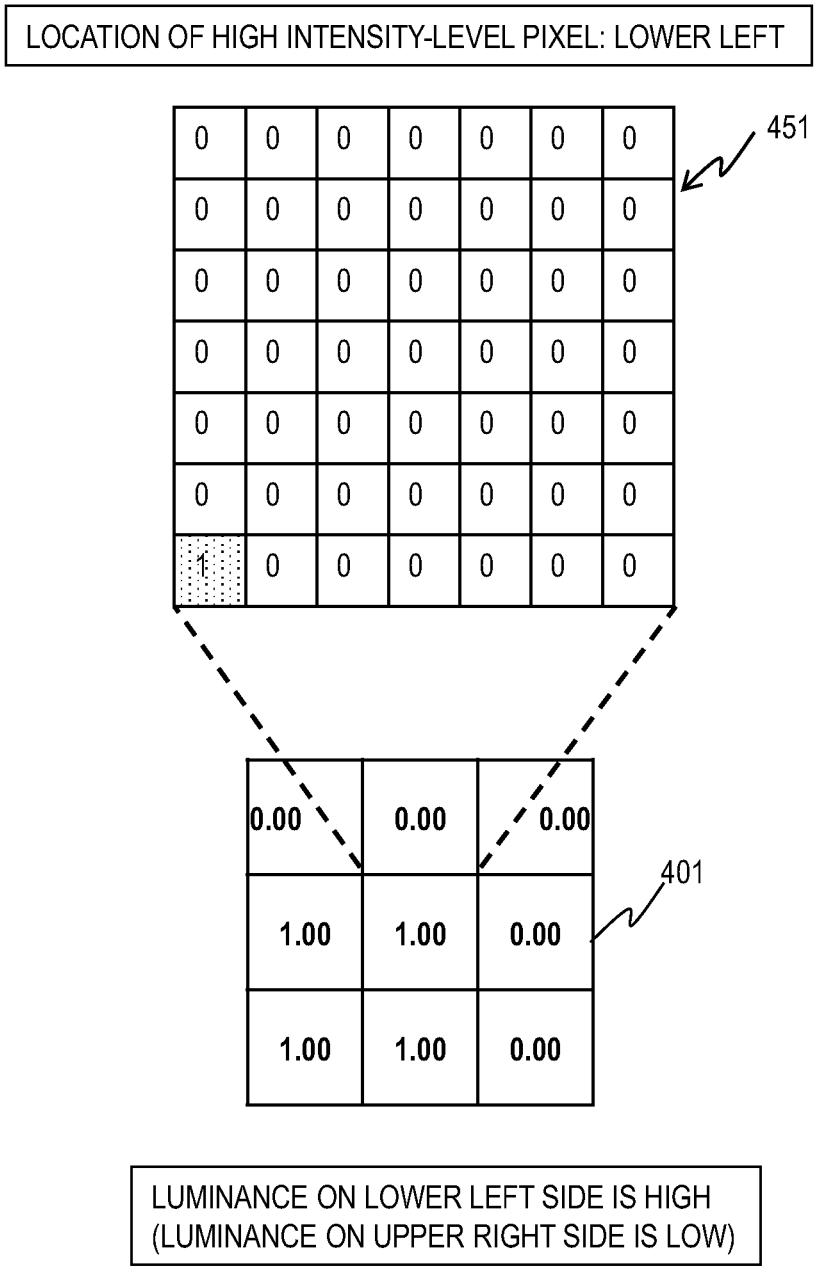
FIG. 11 illustrates still another example of luminance value distribution in a display region block.

FIG. 11 illustrates still another example of luminance value distribution in the display region block 451. In the display region block 451, the pixel at the lower left corner is assigned a luminance value of 1.0 and the other pixels are assigned a luminance value of 0. In accordance with this luminance value distribution, the demanded luminance values for the lower left backlight blocks are higher and the demanded luminance values for the upper right backlight blocks are lower.

Figure 12:
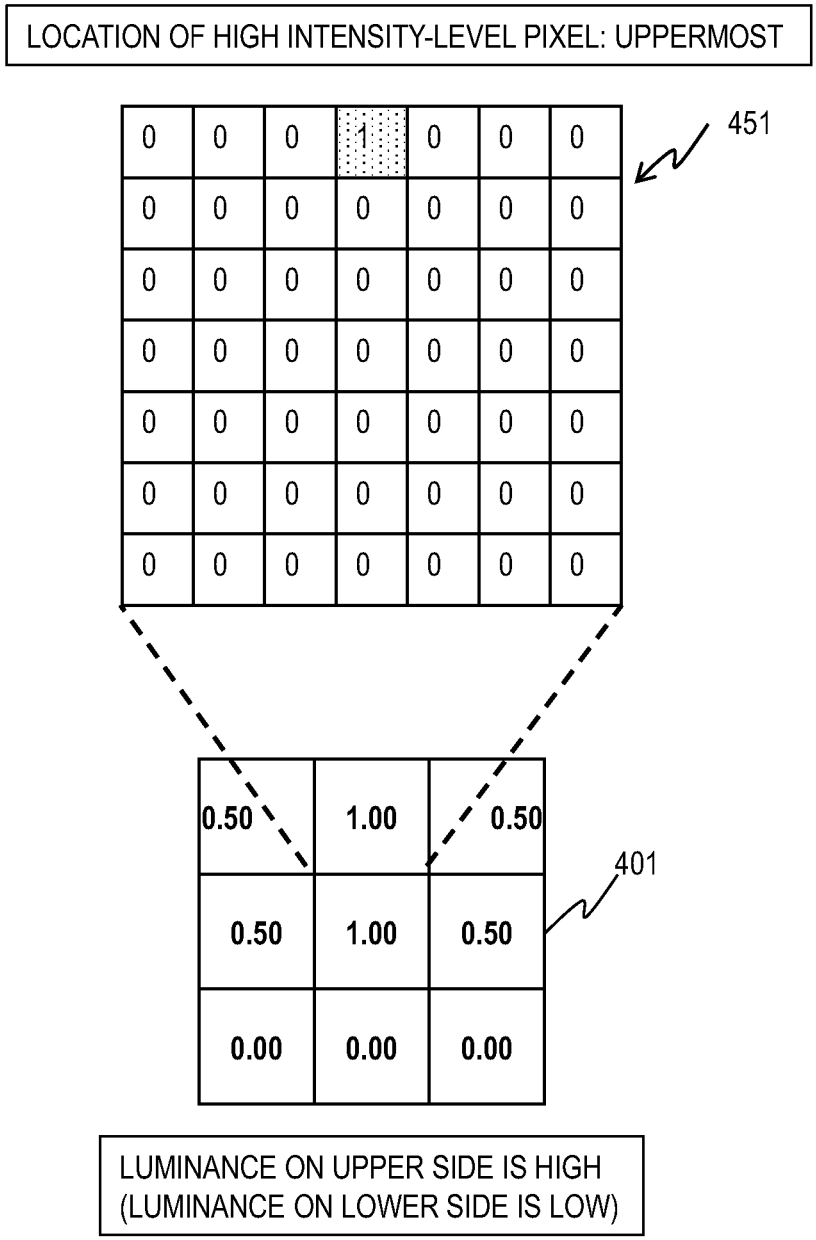
FIG. 12 illustrates still another example of luminance value distribution in a display region block.

FIG. 12 illustrates still another example of luminance value distribution in the display region block 451. In the display region block 451, the pixel at the center in the uppermost row is assigned a luminance value of 1.0 and the other pixels are assigned a luminance value of 0. In accordance with this luminance value distribution, the demanded luminance values for the upper backlight blocks are higher and the demanded luminance values for the lower backlight blocks are lower.

Figure 13:
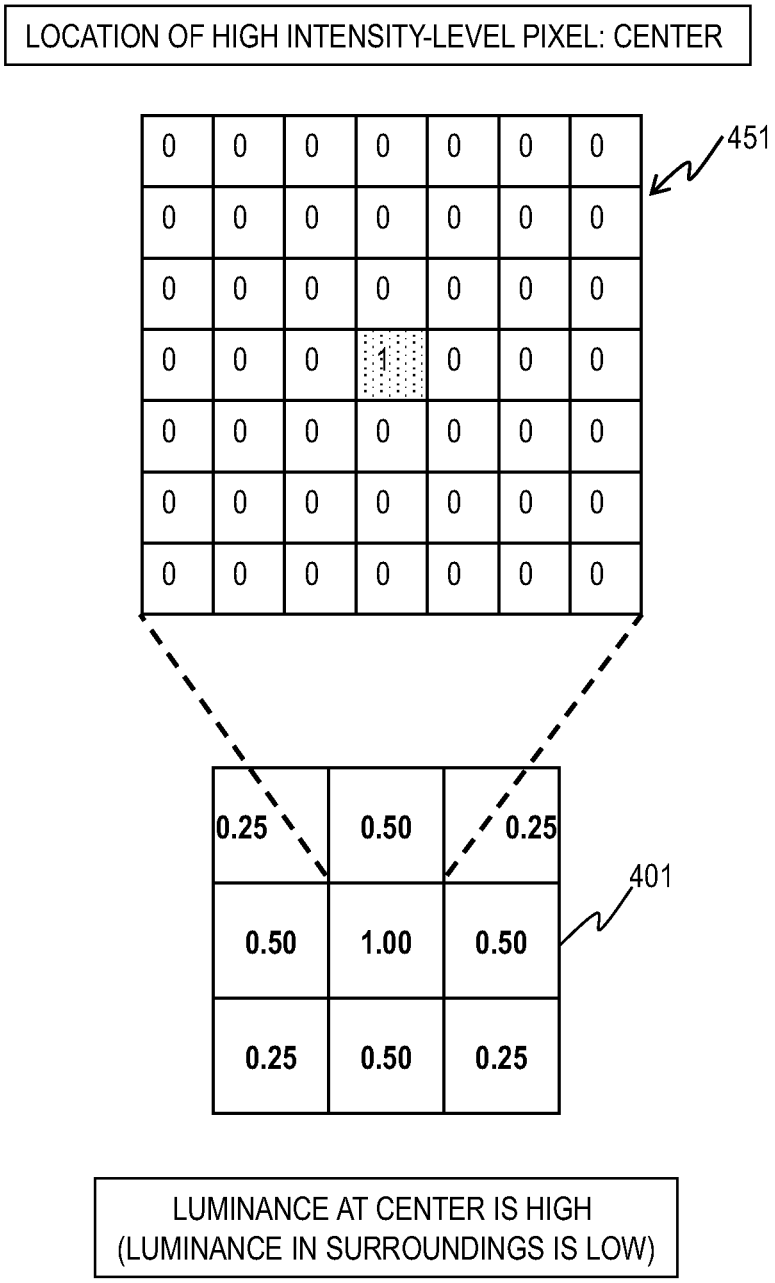
FIG. 13 illustrates still another example of luminance value distribution in a display region block.

FIG. 13 illustrates still another example of luminance value distribution in the display region block 451. In the display region block 451, the pixel at the center is assigned a luminance value of 1.0 and the other pixels are assigned a luminance value of 0. In accordance with this luminance value distribution, the demanded luminance value for the central backlight block is higher and the demanded luminance values for the surrounding backlight blocks are lower.

Figure 14:
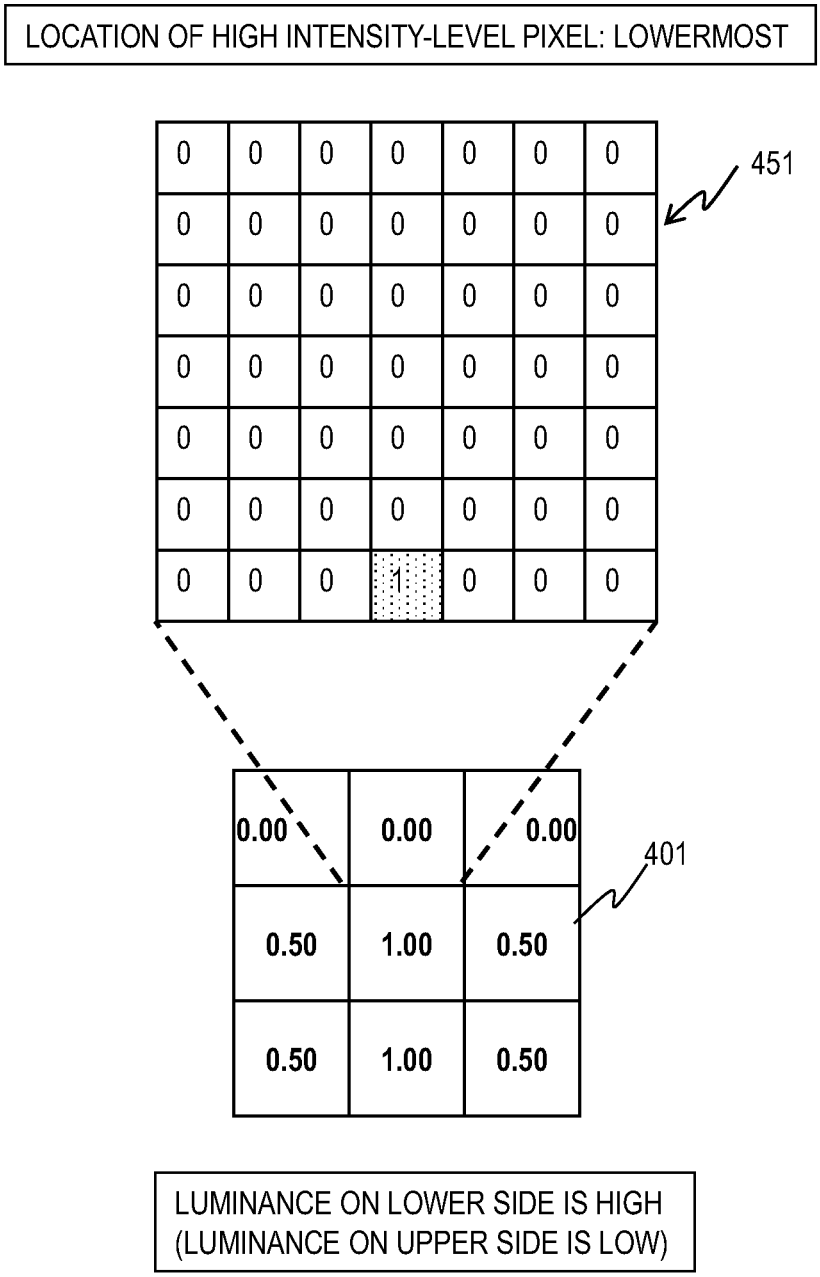
FIG. 14 illustrates still another example of luminance value distribution in a display region block.

FIG. 14 illustrates still another example of luminance value distribution in the display region block 451. In the display region block 451, the pixel at the center in the lowermost row is assigned a luminance value of 1.0 and the other pixels are assigned a luminance value of 0. In accordance with this luminance value distribution, the demanded luminance values for the lower backlight blocks are higher and the demanded luminance values for the upper backlight blocks are lower.

Figure 15:
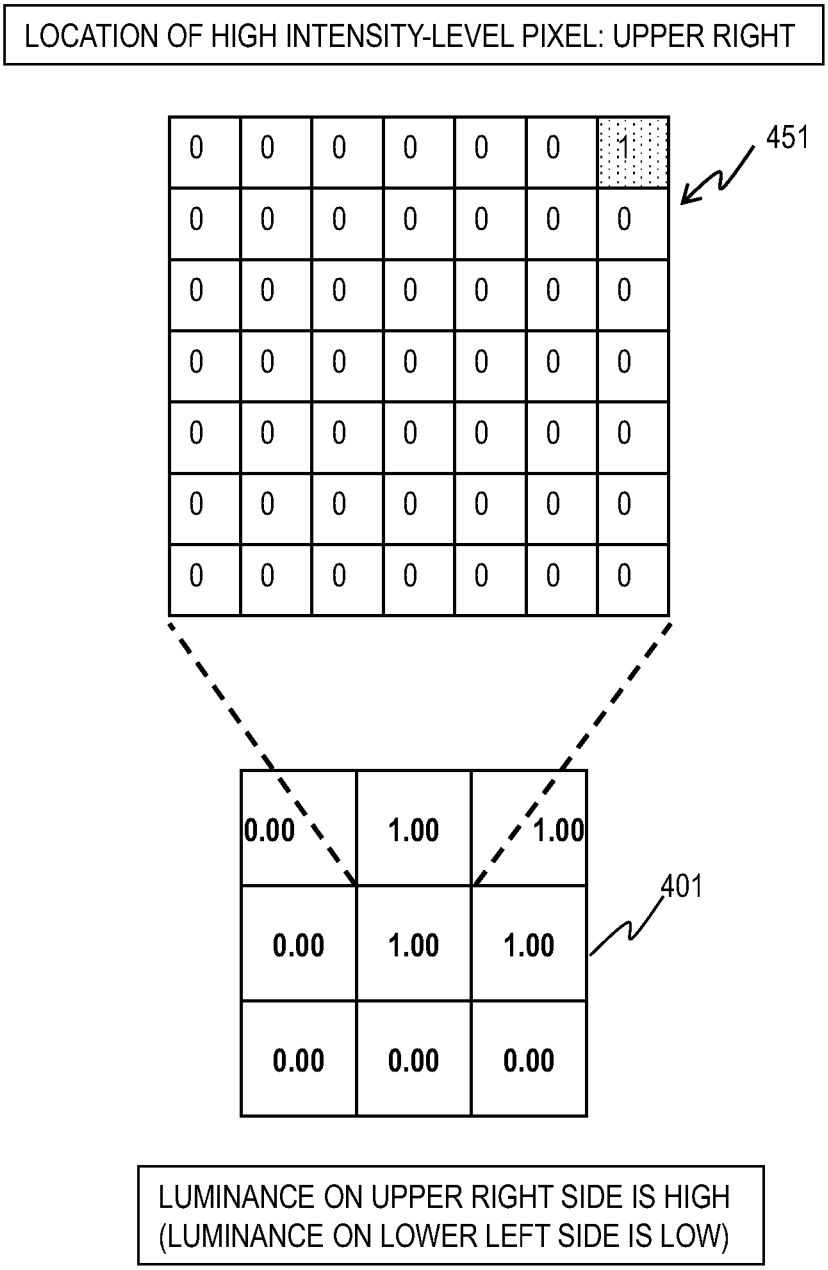
FIG. 15 illustrates still another example of luminance value distribution in a display region block.

FIG. 15 illustrates still another example of luminance value distribution in the display region block 451. In the display region block 451, the pixel at the upper right corner is assigned a luminance value of 1.0 and the other pixels are assigned a luminance value of 0. In accordance with this luminance value distribution, the demanded luminance values for the upper right backlight blocks are higher and the demanded luminance values for the lower left backlight blocks are lower.

Figure 16:
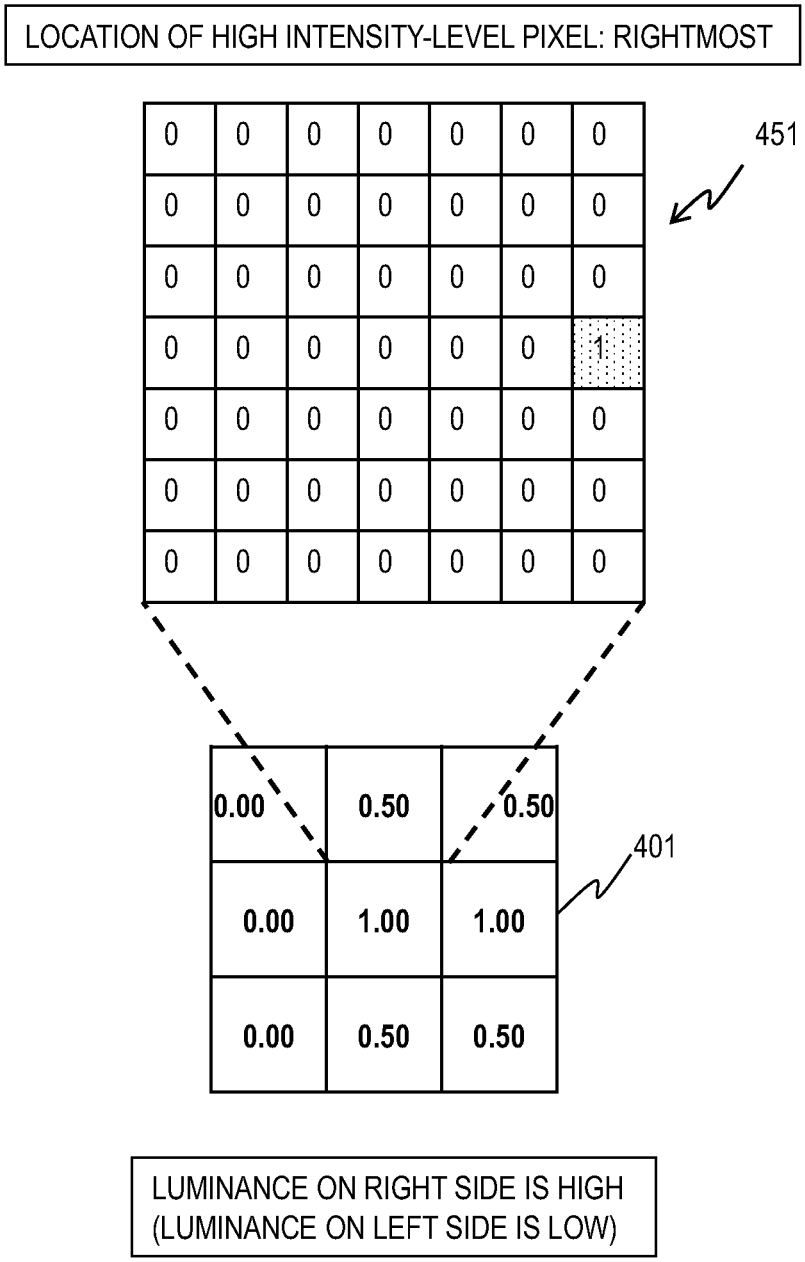
FIG. 16 illustrates still another example of luminance value distribution in a display region block.

FIG. 16 illustrates still another example of luminance value distribution in the display region block 451. In the display region block 451, the pixel at the center in the rightmost column is assigned a luminance value of 1.0 and the other pixels are assigned a luminance value of 0. In accordance with this luminance value distribution, the demanded luminance values for the backlight blocks on the right are higher and the demanded luminance values for the backlight blocks on the left are lower.

Figure 17:
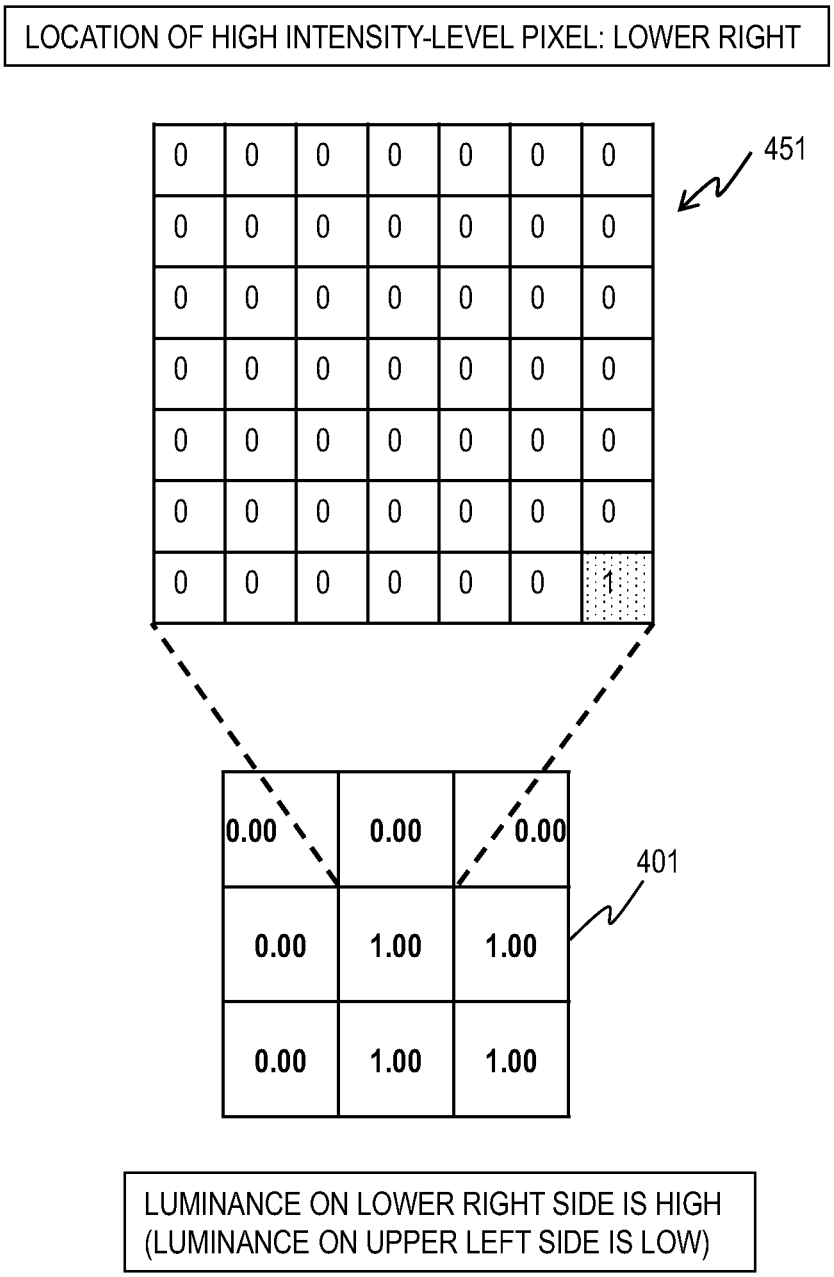
FIG. 17 illustrates still another example of luminance value distribution in a display region block.

FIG. 17 illustrates still another example of luminance value distribution in the display region block 451. In the display region block 451, the pixel at the lower right corner is assigned a luminance value of 1.0 and the other pixels are assigned a luminance value of 0. In accordance with this luminance value distribution, the demanded luminance values for the lower right backlight blocks are higher and the demanded luminance values for the upper left backlight blocks are lower.

Figure 18:
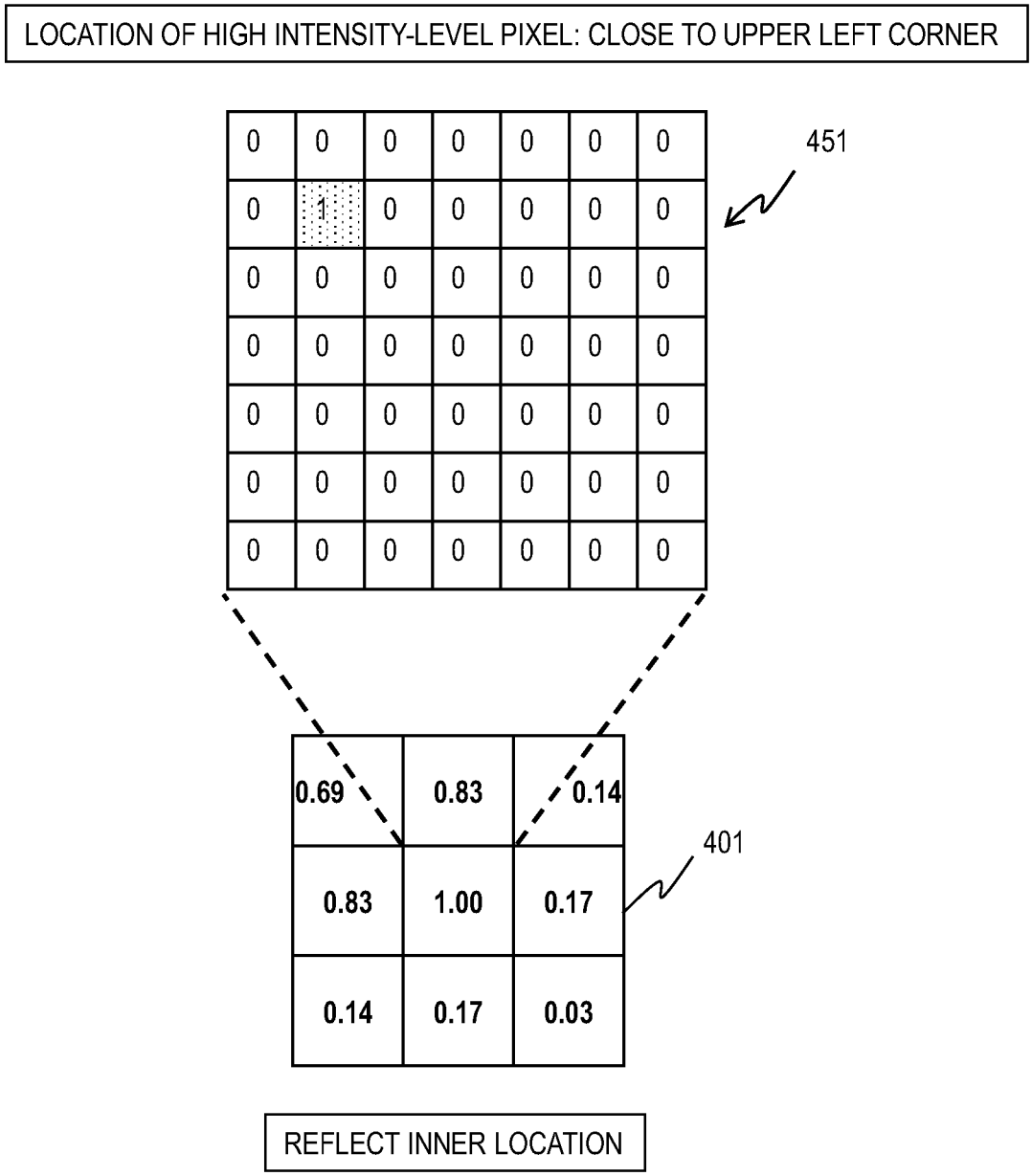
FIG. 18 illustrates still another example of luminance value distribution in a display region block.

FIG. 18 illustrates still another example of luminance value distribution in the display region block 451. In the display region block 451, the pixel located horizontally and vertically inner than the upper left corner by one pixel is assigned a luminance value of 1.0 and the other pixels are assigned a luminance value of 0. Compared to the example of the luminance value distribution in FIG. 9, the pixel at the luminance value of 1.0 is located on the lower right by one pixel. This location of this pixel at the luminance value of 1.0 is reflected to the demanded luminance values for the backlight blocks 401.

That is to say, the demanded luminance values for the upper backlight blocks are low and the demanded luminance values for the lower backlight blocks are high, compared to the distribution of backlight luminance values in FIG. 9. In addition, the demanded luminance values for the backlight blocks on the left are low and the demanded luminance values for the backlight blocks on the right are high.

Figure 19:
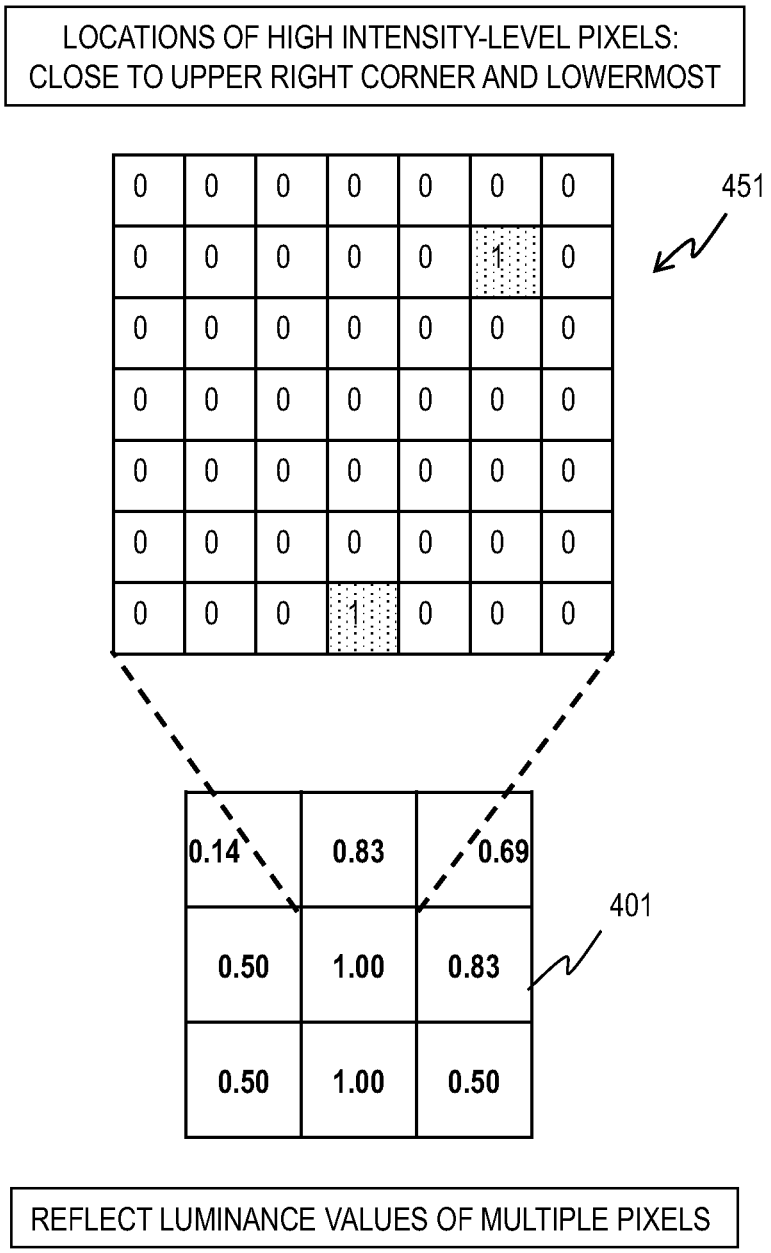
FIG. 19 illustrates still another example of luminance value distribution in a display region block.

FIG. 19 illustrates still another example of luminance value distribution in the display region block 451. Two pixels are assigned a luminance value of 1.0 and the other pixels are assigned a luminance value of 0. As described above, the demanded luminance value for each backlight block is the higher value between the values demanded from the two pixels to the backlight block based on the locations and the luminance values of the pixels.

The luminance value distribution in the display region block 451 in FIG. 19 includes a luminance value of 1.0 at an upper right pixel, in addition to the luminance value distribution in FIG. 14. The luminance values demanded from this pixel are reflected to the demanded luminance values for the three backlight blocks 401 in the uppermost row and the backlight block 401 at the center right.

FIG. 20 illustrates still another example of luminance value distribution in the display region block 451. In the display region block 451, the pixel located horizontally and vertically inner than the upper right corner by one pixel is assigned a luminance value of 0.5 and the other pixels are assigned a luminance value of 0. Compared to the example of the luminance value distribution in FIG. 15, the pixel at a half of the luminance value is located on the lower left by one pixel. These luminance value and location of this pixel are reflected to the demanded luminance values for the backlight blocks 401.

That is to say, the demanded luminance values for the backlight blocks on the left and the lower side are high and the demanded luminance values for the central backlight block and the backlight blocks on the right and the upper side are low, compared to the distribution of backlight luminance values in FIG. 15.

Figure 21:
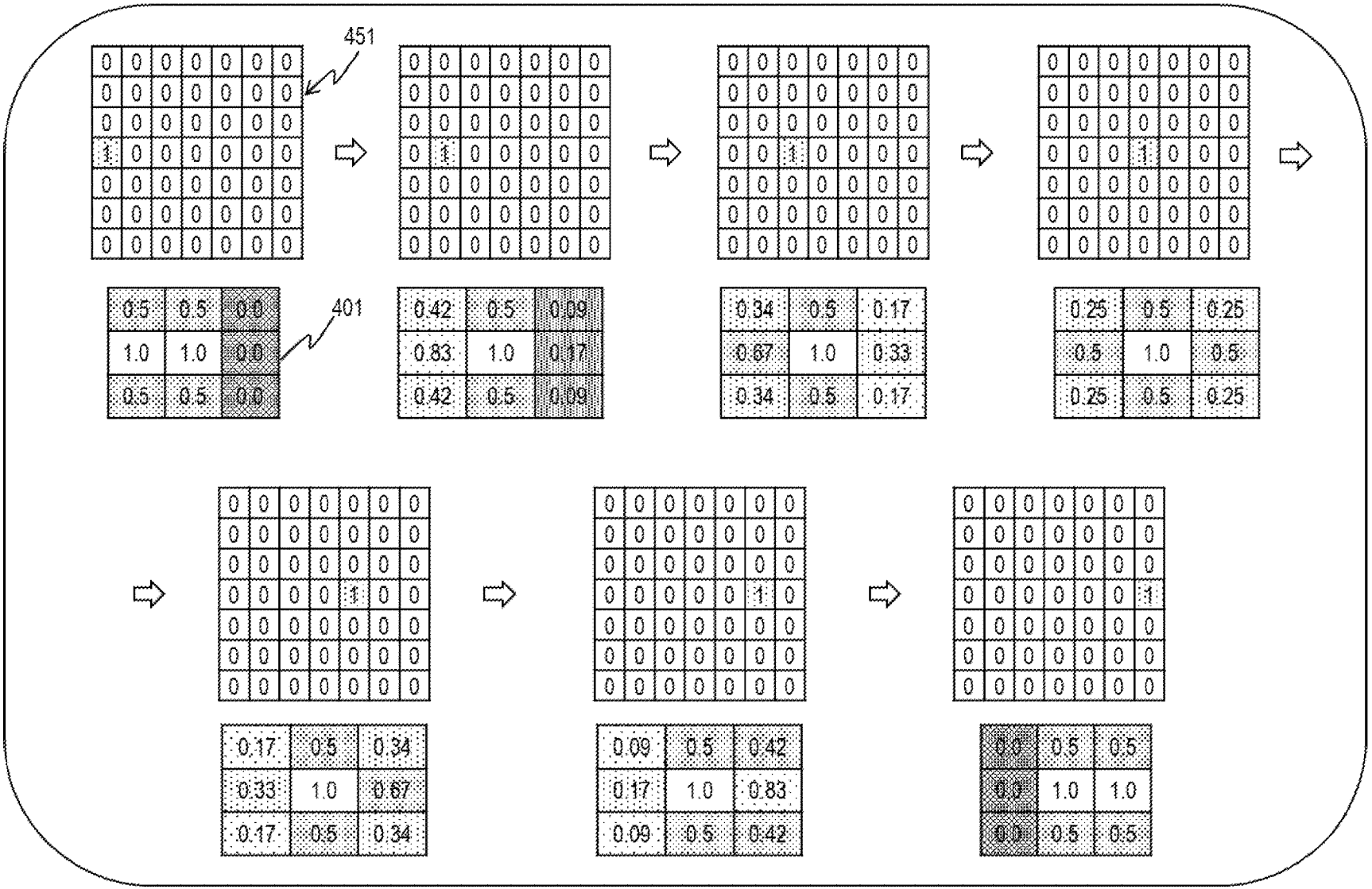
FIG. 21 illustrates changes in luminance values of backlight blocks because of successive changes in position of a lighting pixel in a display region.

FIG. 21 illustrates changes in luminance values of the backlight blocks because of successive changes in position of a lighting pixel in a display region. FIG. 21 illustrates an example where a pixel at a luminance value of 1.0 moves from the left to the right within one display region block. In each state, only one of the pixels lights and the luminance values of the other pixels are 0. FIG. 21 further provides luminance distributions in the backlight blocks 401 each associated with a luminance distribution in the display region block 451.

As the position of the pixel lighting at a high intensity level in a display region block 451 moves, the amounts of light emission (luminance values) of the backlight blocks 401 surrounding the backlight block 401 opposite to the display region block 451 change successively in accordance with the results of the above-described calculation of demanded luminance values for the backlight blocks 401. In the example of FIG. 21, one display region block 451 consists of 7×7 pixels and accordingly, each backlight block 401 shows seven steps of changes in the amount of light emission. In actual implementation, the display region block 451 can consist of a larger number of pixels.

Taking an example of a 12.3"-wide HD liquid crystal display panel, a configuration where the backlight is divided into 96×36=3456 blocks is discussed. The number of pixels constituting one display region (pixels opposed to one backlight block) can be approximately 20×20=400. Accordingly, each backlight block shows 20 steps of changes in the amount of light emission; the variation per step is small enough to achieve smooth change of luminance.

Although FIG. 21 illustrates smooth change in the amount of light emission of the backlight blocks for horizontal movement of a lighting pixel, the backlight blocks show the smooth change in the amount of light emission for the movement in other directions, specifically, the vertical direction and diagonal directions.

As illustrated in FIG. 21, the amounts of light emission of the adjacent backlight blocks getting closer to the high-luminance pixel are increased and the amounts of light emission of the adjacent backlight blocks getting away from the high-luminance pixel are decreased. This operation prevents abrupt change of the luminance of each backlight block 401. In a configuration where the luminance value of a backlight block is determined based on only the information on the high-luminance pixel in the display region block opposite thereto or a configuration where the luminance values of the surrounding backlight blocks are determined independently from the position of the high-luminance pixel in the display region block, the luminance of a backlight changes abruptly when the lighting pixel crosses the boundary between backlight blocks, causing degradation of the image quality. The configuration disclosed in this specification prevents this degradation of the image quality.

Configurations of the backlight 30 are described. A direct backlight can include a light source array disposed within the backlight plane to be opposite to a liquid crystal display panel 20 and a diffuser panel between the light source array and the liquid crystal display panel 20. A typical example of the light source is an LED. A plurality of LEDs can be disposed in a backlight block 401. A desirable number of LEDs can be included in one backlight block 401. An optimum number of LEDs are disposed at optimum locations based on the luminance efficiency and luminance distribution of the LEDs.

Instead of the above-described direct type, the backlight 30 can be of an edge type, which includes a light guide panel and light sources disposed on both sides. The backlight 30 can be composed of backlight blocks disposed in a matrix or backlight blocks disposed in a horizontal or a vertical line.

Embodiment 2

Hereinafter, another example of the method of determining a demanded luminance value for a backlight block based on the luminance values and the locations of pixels is described. The following method divides one backlight blocks to define a plurality of internal backlight blocks. The part of the display region opposite to an internal backlight block is defined as internal display region block. One display region block is a part of the display region opposite to a backlight block and composed of a plurality of internal display region blocks.

The backlight luminance controller 200 determines a luminance value of an internal display region block from the luminance values of the pixels in the internal display region block. The backlight luminance controller 200 determines demanded luminance values for the internal backlight blocks associated with the internal display region block based on the luminance value of the internal display region block. The backlight luminance controller 200 determines a luminance value for a backlight block based on the demanded luminance values for its internal backlight blocks.

Figure 22:
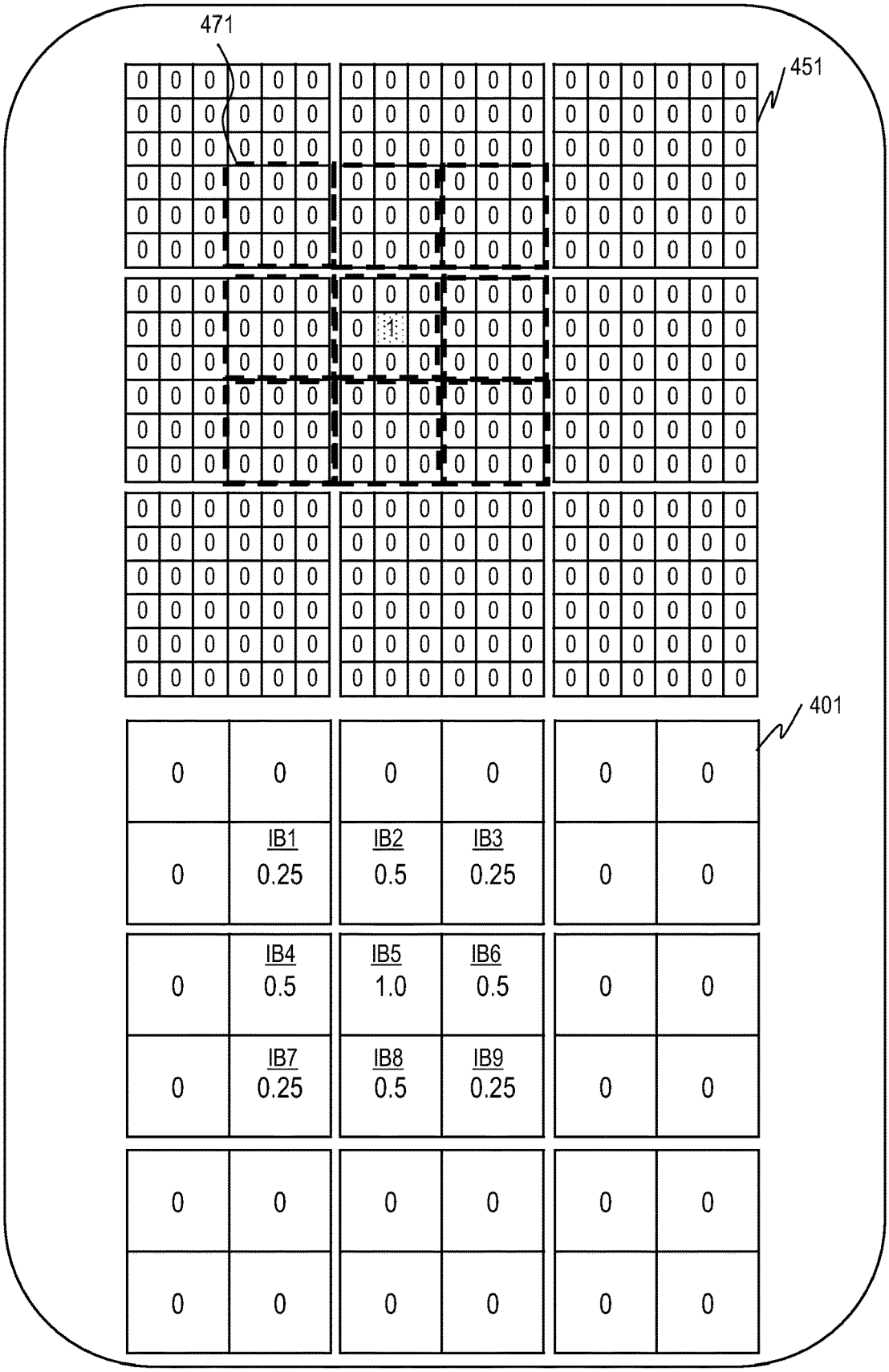
FIG. 22 illustrates a plurality of display region blocks and backlight blocks opposite to the display region blocks in Embodiment 2.

A specific example is described. FIG. 22 illustrates a plurality of display region blocks 451 and backlight blocks 401 opposite to the display region blocks 451. FIG. 22 includes nine display region blocks 451 disposed in a matrix and one of them is provided with a reference sign 451 by way of example. For clear understanding of the description, the display region blocks 451 adjacent to each other are separated by space, but the actual display region blocks 451 are in contact with each other.

In the example of FIG. 22, one display region block 451 is divided into four internal display region blocks 471. Some of the internal display region blocks 471 are represented by rectangles surrounded by dashed lines and one of them is provided with a reference sign 471 by way of example.

FIG. 22 further illustrates nine backlight blocks 401 opposite to the plurality of display region blocks 451. One of the backlight blocks is provided with a reference sign 401 by way of example. For clear understanding of the description, the backlight blocks 401 adjacent to each other are separated by space, but the actual backlight blocks 401 are in contact with each other. One backlight block 401 is divided into four internal backlight blocks. Some of the internal backlight blocks are provided with a reference sign. Specifically, the internal backlight blocks IB1 to IB9 are opposite to the internal display region blocks 471 surrounded by a dashed line.

In the example of FIG. 22, only one of the pixels lights at a luminance value of 1.0 and the other pixels do not light (the luminance value: 0). The internal backlight block IB5 is the internal backlight block opposite to the internal display region block including the lighting pixel. The luminance values (demanded luminance values) for the internal backlight blocks IB1 to IB9 are indicated by the numbers within the rectangles. Specifically, the luminance value for the internal backlight block IB5 is 1.0; the luminance values for the internal backlight blocks IB2, IB4, IB6, and IB8 horizontally and vertically adjacent to the internal backlight block IB5 are 0.5; and the luminance values for the internal backlight blocks IB1, IB3, IB7, and IB9 diagonally adjacent to the internal backlight block IB5 are 0.25.

The backlight luminance controller 200 in this example determines demanded luminance values for the internal backlight blocks associated with an internal display region block 471 independently from the locations of the pixels in the internal display region block 471. The weights to be assigned from an internal display region block to internal backlight blocks are predetermined. In the example of FIG. 22, the weight for the opposite internal backlight block is 1.0; the weights for the horizontally and vertically adjacent backlight blocks are 0.5; and the weights for the diagonally adjacent backlight blocks are 0.25.

The backlight luminance controller 200 selects the highest luminance value in the internal display region block and multiplies the highest luminance value by the predetermined weights to determine the demanded luminance values for the individual associated internal backlight blocks. Accordingly, the demanded luminance values for the internal backlight blocks IB1 to IB9 are as shown in FIG. 22.

Figure 23:
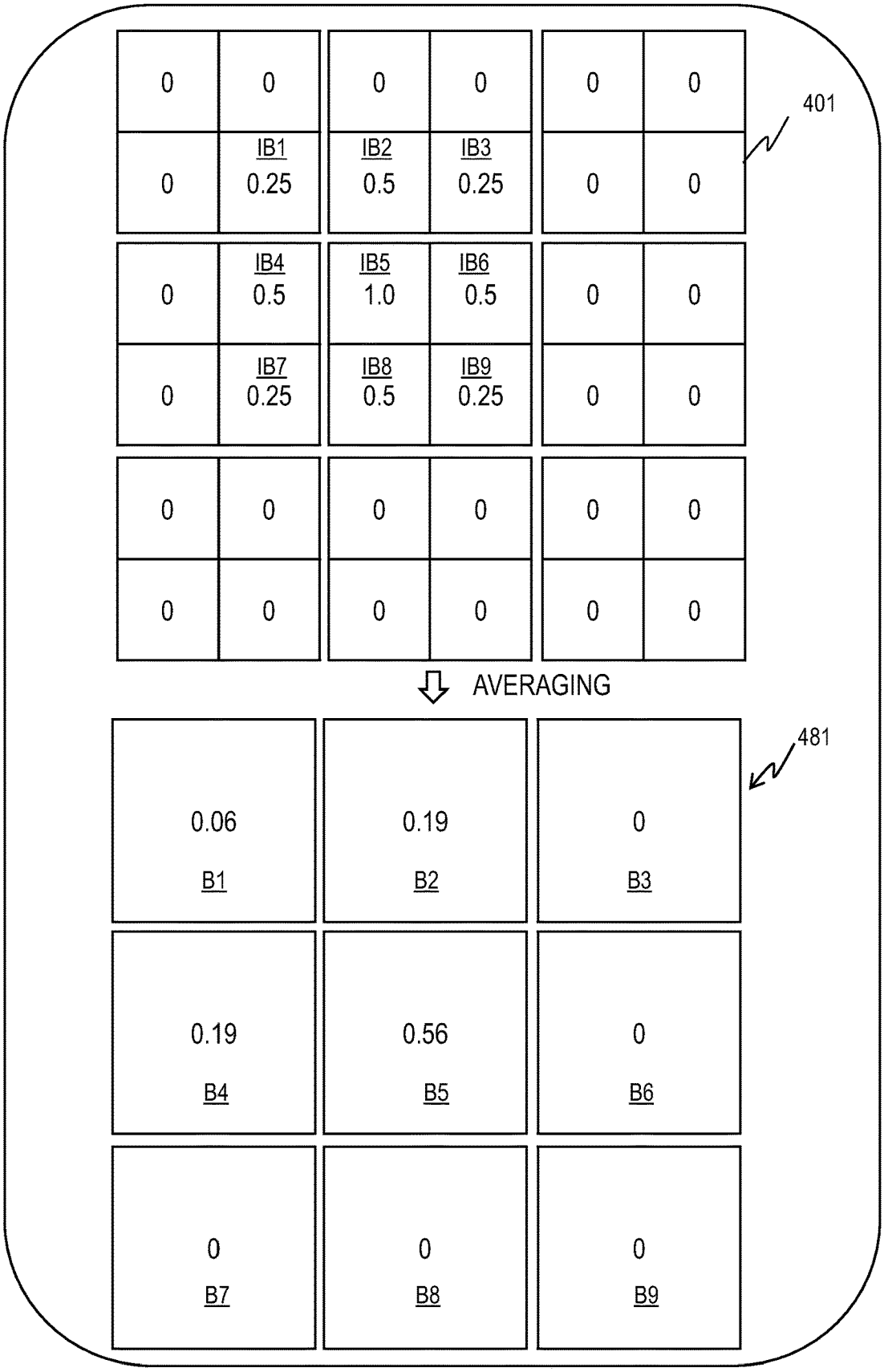
FIG. 23 provides average values of the backlight blocks obtained by averaging luminance values for the internal backlight blocks in FIG. 22.

Next, the backlight luminance controller 200 calculates an average value of the demanded luminance values for the internal backlight blocks, on each of the backlight blocks 401. FIG. 23 provides the average values 481 of the backlight blocks B1 to B9 obtained by averaging the luminance values for the internal backlight blocks in FIG. 22.

The backlight block B5 consists of internal backlight blocks IB5, IB6, IB8, and IB9. The internal backlight block IB1 is included in the backlight block B1. The internal backlight blocks IB2 and IB3 are included in the backlight block B2. The internal backlight blocks IB4 and IB7 are included in the backlight block B4. For example, the value about the backlight block B5 is (1+0.5+0.5+0.25)/4=0.56.

Figure 24:
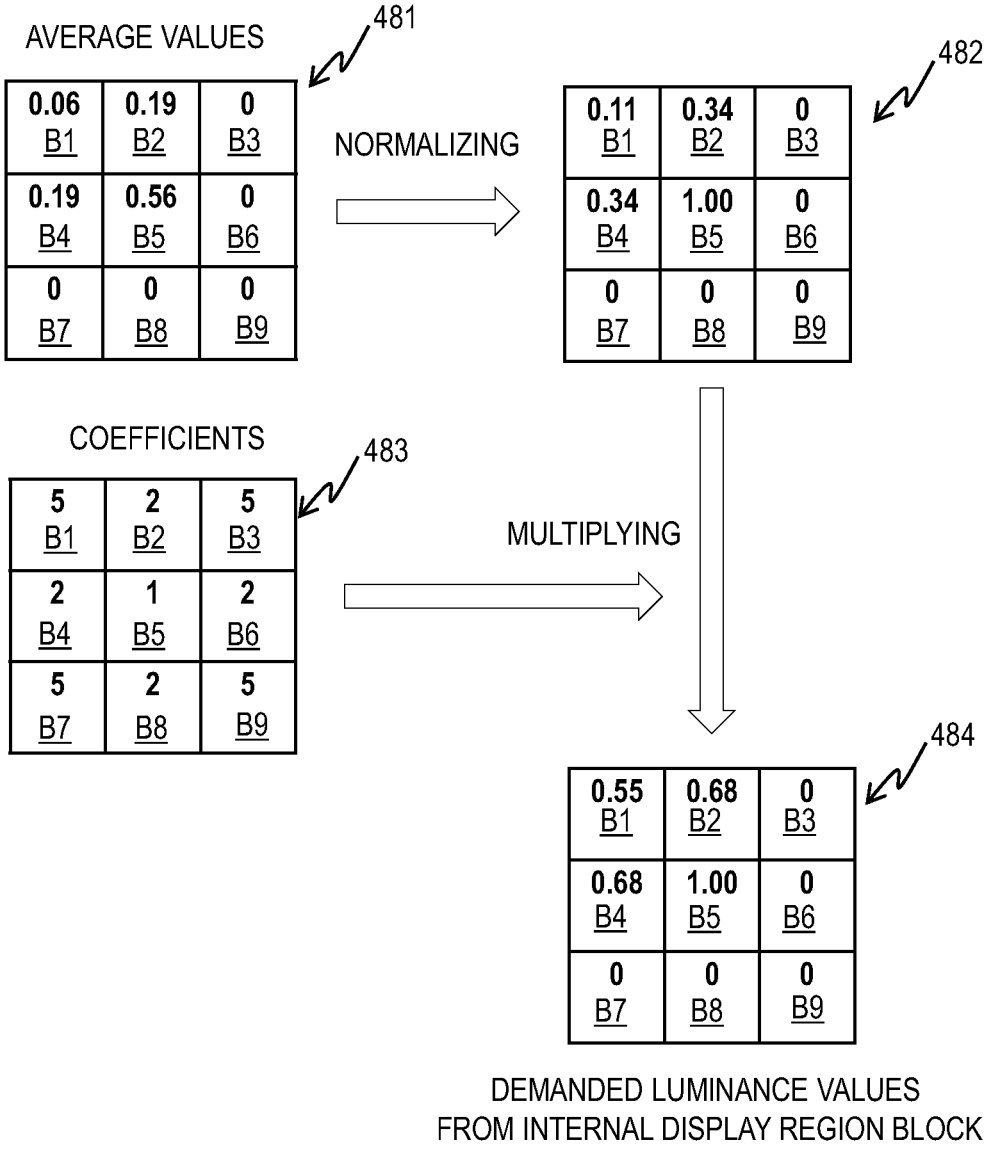
FIG. 24 illustrates an example of calculating demanded luminance values from an internal display region block.

Next, as illustrated in FIG. 24, the backlight luminance controller 200 normalizes the values 481 of the backlight blocks. Specifically, the backlight luminance controller 200 normalizes the values of the backlight blocks so that the luminance value of the backlight block opposite to the internal display region block becomes the same (1 in FIG. 24) as the luminance value of the internal display region block. The normalized values 482 of the backlight blocks B1 to B9 are as shown in FIG. 24.

As further illustrated in FIG. 24, the backlight luminance controller 200 multiplies the normalized values 482 by predetermined coefficients 483 to determine luminance values demanded from the internal display region block to the backlight blocks B1 to B9. The coefficients (weights) make the calculated demanded luminance values for the surrounding backlight blocks more appropriate.

The above-described control lights the backlight blocks close to a high intensity-level pixel in a video frame at higher luminance and the backlight blocks far from the pixel at lower luminance. Specifically, as illustrated in FIG. 24, the backlight blocks B1, B2, and B4 are lit at higher luminance and the backlight blocks B6, B8, and B9 are lit at lower luminance. As noted from this example, this control enhances the contrast within the same plane. Furthermore, downscaling the circuit is available, compared to the method including obtaining information on the locations of high intensity-level regions in units of pixels.

Figure 25:
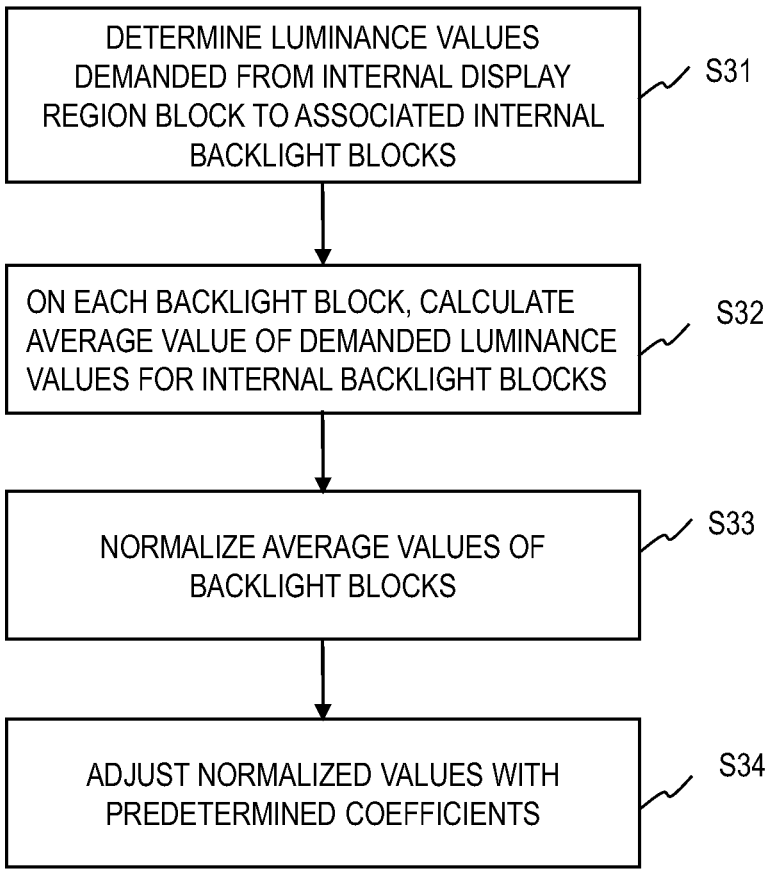
FIG. 25 is a flowchart of processing to determine luminance values demanded from an internal display region block to individual backlight blocks.

FIG. 25 is a flowchart of the above-described processing to determine luminance values demanded from an internal display region block to individual backlight blocks. As described above, the backlight luminance controller 200 determines demanded luminance values for the internal backlight blocks associated with an internal display region block based on the luminance values in the internal display region block (S31). In the foregoing example, the backlight luminance controller 200 determines the products of the highest luminance value in the internal display region block and predetermined coefficients for the associated internal backlight blocks to be the demanded luminance values for the internal backlight blocks.

Next, the backlight luminance controller 200 calculates an average value of demanded luminance values for the internal backlight blocks, on each of the backlight blocks including any of the associated internal backlight blocks (S32).

Next, the backlight luminance controller 200 normalizes the values of the backlight blocks so that the average value of the backlight block opposite to the internal display region block becomes the highest luminance value of the internal display region block (S33).

Next, the backlight luminance controller 200 adjusts the normalized values with predetermined coefficients to determine the luminance values demanded from the internal display region block to the backlight blocks (S34). In the foregoing example, the backlight luminance controller 200 multiplies the normalized values by predetermined coefficients to calculate demanded luminance values for the backlight blocks.

Embodiment 3

Figure 26:
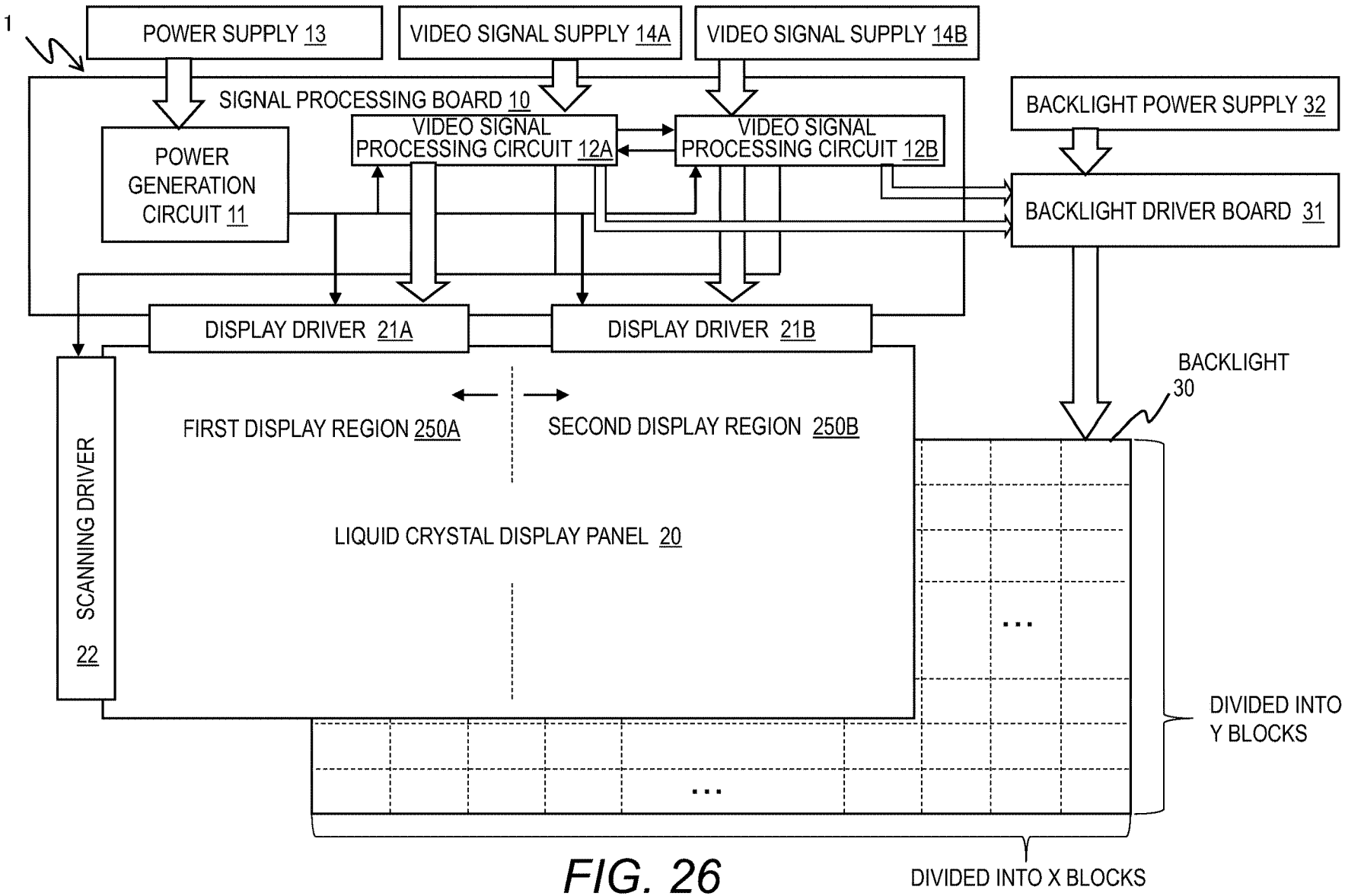
FIG. 26 illustrates a configuration example of a display device in Embodiment 3.

FIG. 26 illustrates a configuration example of a display device in another embodiment. The following mainly describes differences from the configuration example in FIG. 1. The liquid crystal display device 1 includes video signal supplies 14A and 14B and display drivers 21A and 21B. The signal processing board 10 includes video signal processing circuits 12A and 12B. The video signal processing circuit 12A is a first processing circuit and the video signal processing circuit 12B is a second processing circuit. This configuration can be employed when the display region is divided horizontally or vertically to be driven by different ICs because the display region has a resolution too high to be driven by one IC.

The liquid crystal display panel 20 includes a first display region 250A and a second display region 250B adjoining each other. The video signal processing circuit 12A performs processing involved in displaying images, such as generating a signal for displaying an image in the first display region 250A and a signal for controlling the backlight 30. The video signal processing circuit 12B performs processing involved in displaying images, such as generating a signal for displaying an image in the second display region 250B and a signal for controlling the backlight 30. The video signal supply 14A supplies a video signal to the video signal processing circuit 12A and the video signal supply 14B supplies a video signal to the video signal processing circuit 12B.

The display driver 21A generates a data signal from the video signal sent from the video signal processing circuit 12A and supplies the data signal to the first display region 250A. The display driver 21B generates a data signal from the video signal sent from the video signal processing circuit 12B and supplies the data signal to the second display region 250B. The video signal processing circuit 12A further sends a timing signal to the display driver 21A and the display driver 21A generates a data signal from the received video signal and supplies the data signal to the first display region 250A in accordance with the timing signal. The video signal processing circuit 12B also sends the timing signal to the display driver 21B. The display driver 21B generates a data signal from the received video signal and supplies the data signal to the second display region 250B in accordance with the timing signal.

The video signal processing circuit 12A converts the data arrangement of the video signal input from the external to send it to the display driver 21A and generates and sends a timing signal for the display driver 21A and the scanning driver 22 to operate using the power supplied from the power generation circuit 11. The video signal processing circuit 12A further generates a driving control signal for controlling the driving of the backlight 30 and sends the driving control signal to the backlight driver board 31.

The video signal processing circuit 12B converts the data arrangement of the video signal input from the external to send it to the display driver 21B and generates and sends a timing signal for the display driver 21B and the scanning driver 22 to operate using the power supplied from the power generation circuit 11. The video signal processing circuit 12B further generates a driving control signal for controlling the driving of the backlight 30 and sends the driving control signal to the backlight driver board 31.

The backlight driver board 31 includes a backlight driver circuit and controls the lighting (luminance) of the backlight 30 in accordance with the driving control signals sent from the video signal processing circuits 12A and 12B.

Each of the video signal processing circuits 12A and 12B generates a driving control signal for controlling the luminance of individual blocks of the backlight 30 and sends the driving control signal to the backlight driver board 31. The backlight driver board 31 drives and controls the light sources of the backlight 30 so that the individual blocks light at the luminance values specified in the driving control signals from the video signal processing circuits 12A and 12B.

The video signal processing circuit 12A generates a timing signal for the display driver 21A and the scanning driver 22 in accordance with the input timing signal for the video signal and also, successively sends a signal (frame signal) of each video frame in the video signal to the display driver 21A. The video signal processing circuit 12B generates a timing signal for the display driver 21B and the scanning driver 22 in accordance with the input timing signal for the video signal and also, successively sends a signal (frame signal) of each video frame in the video signal to the display driver 21B.

The video signal processing circuit 12A analyzes the video frame, generates a driving control signal for the backlight 30 to illuminate the first display region 250A from its behind based on the analysis result, and sends the driving control signal to the backlight 30. The video signal processing circuit 12B analyzes the video frame, generates a driving control signal for the backlight 30 to illuminate the second display region 250B from its behind based on the analysis result, and sends the driving control signal to the backlight 30.

Figure 27:
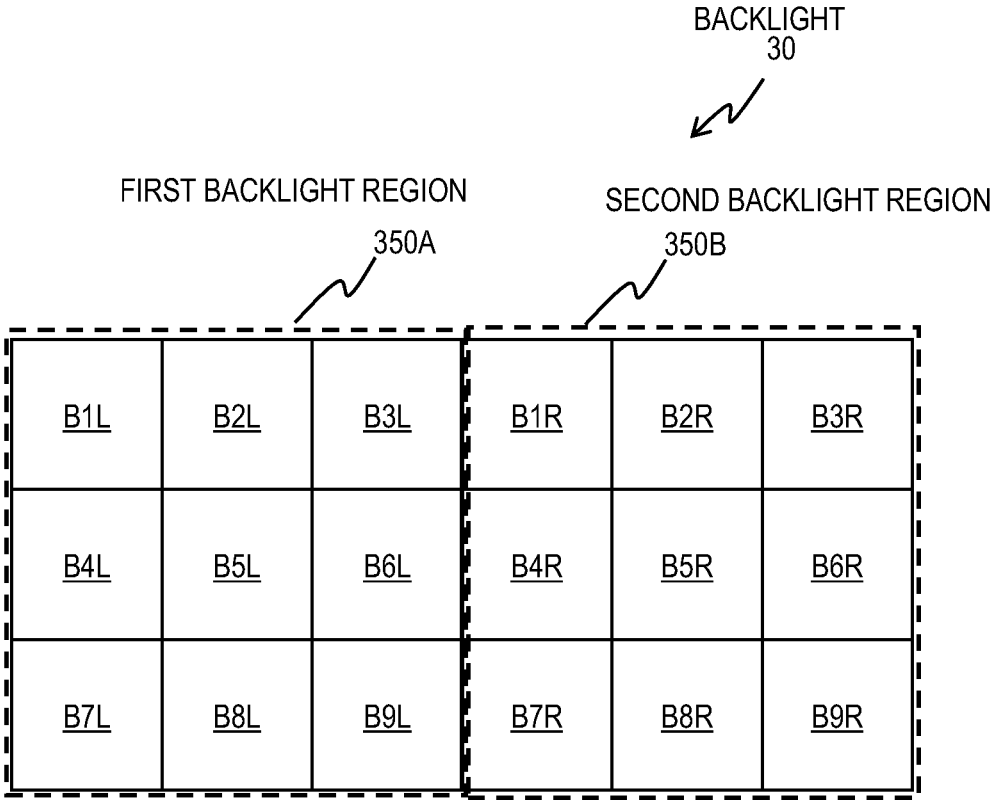
FIG. 27 schematically illustrates a configuration of a backlight.

FIG. 27 schematically illustrates the configuration of the backlight 30. The backlight 30 consists of a first backlight region 350A on the left and a second backlight region 350B on the right. The first backlight region 350A is directly beneath the first display region 250A. The first backlight region 350A is located behind and opposite to the first display region 250A to illuminate the first display region 250A. The second backlight region 350B is directly beneath the second display region 250B. The second backlight region 350B is located behind and opposite to the second display region 250B to illuminate the second display region 250B.

The first backlight region 350A consists of nine backlight blocks (first backlight blocks) B1L to B9L. Although a case of nine backlight blocks is described here, the number of backlight blocks is not limited to nine; the first backlight region 350A can consist of N×M blocks (N and M are natural numbers). The second backlight region 350B consists of nine backlight blocks (second backlight blocks) B1R to B9R. The backlight blocks B3L, B6L, and B9L adjoin the second backlight region 350B. The backlight blocks B1R, B4R, and B7R adjoin the first backlight region 350A.

The video signal processing circuit 12A sends information on luminance values demanded from the display region blocks in the first display region 250A to the backlight blocks in the second backlight region 350B to the video signal processing circuit 12B. The video signal processing circuit 12B controls the luminance of the second backlight region 350B based on the luminance values demanded from the display region blocks in the second display region 250B and the luminance values demanded from the display region blocks in the first display region 250A that are received from the video signal processing circuit 12A.

The video signal processing circuit 12B sends information on luminance values demanded from the display region blocks in the second display region 250B to the backlight blocks in the first backlight region 350A to the video signal processing circuit 12A. The video signal processing circuit 12A controls the luminance of the first backlight region 350A based on the luminance values demanded from the display region blocks in the first display region 250A and the luminance values demanded from the display region blocks in the second display region 250B that are received from the video signal processing circuit 12B.

The luminance values demanded from a display region block to backlight blocks can be determined as described in the foregoing other embodiments. Each of the video signal processing circuits 12A and 12B reflects the luminance values demanded from the display region that is not its own territory to the luminance control of the backlight region of its own territory to prevent unnatural luminance change at the boundary between the two display regions 250A and 250B.

Hereinafter, an example of communicating information on demanded luminance values from display region blocks between the video signal processing circuits 12A and 12B and reflecting demanded luminance values from one display region to luminance control of the backlight region for the other display region is described. It is assumed that the luminance value for each backlight block is determined based on demanded luminance values from the display region blocks opposite to the backlight block and eight adjacent backlight blocks surrounding the backlight block, as described above. Furthermore, it is assumed that the demanded luminance value from a display region block is determined depending on the location of the pixel at the highest luminance value in the display region block.

Figure 28:
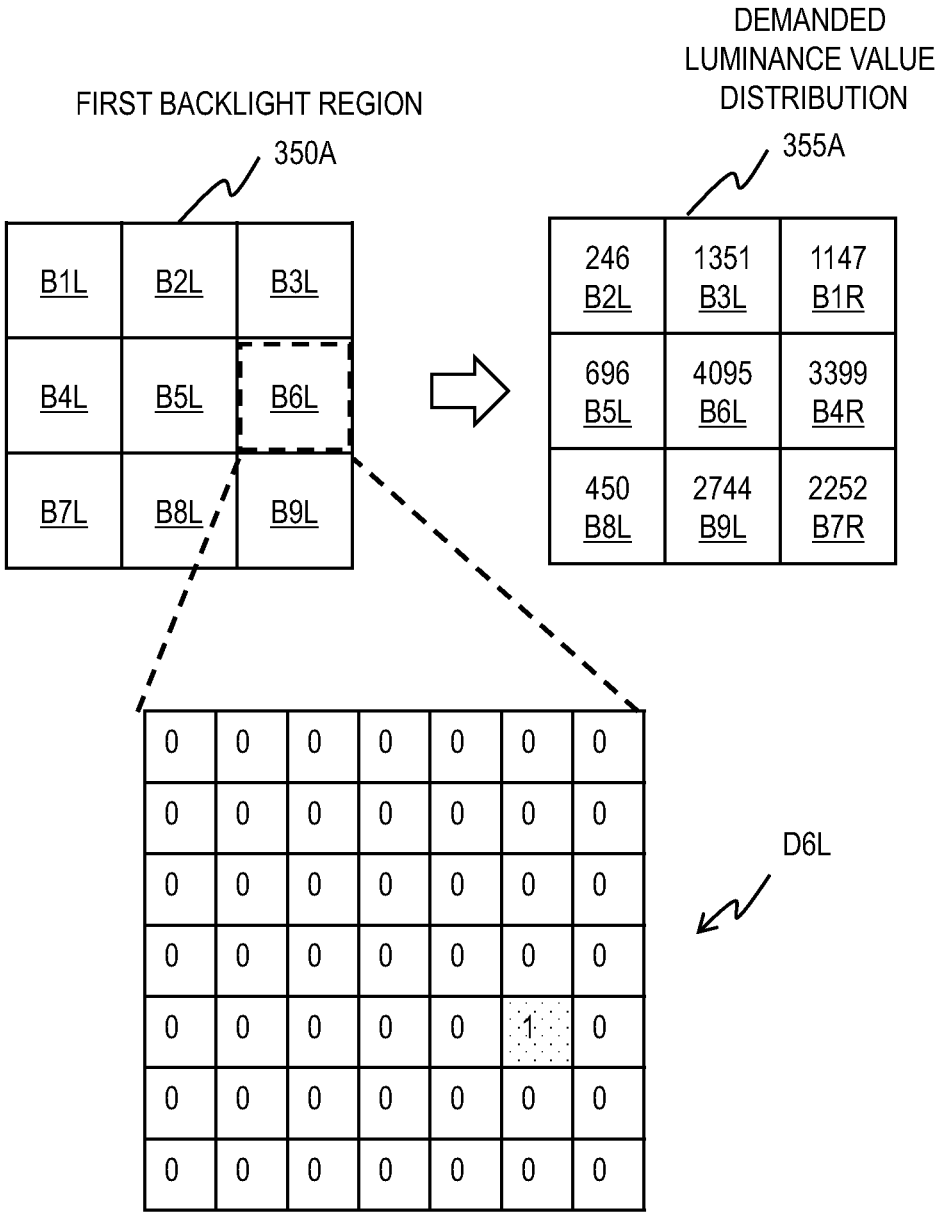
FIG. 28 provides a demanded luminance value distribution from a first display region opposite to a first backlight region.

FIG. 28 provides a demanded luminance value distribution from the first display region 250A opposite to the first backlight region 350A. In this example, only the display region block D6L opposite to the backlight block B6L includes a value to be lit. In the display region block D6L, only one pixel is assigned the maximum luminance value of 1 and the other pixels are assigned a luminance value of 0.

The demanded luminance value distribution 355A from the display region block D6L indicates the backlight blocks provided with a demanded luminance value and demanded luminance values expressed by a 12-bit resolution (the maximum value: 4095). The demanded luminance values are for the backlight block B6L and its surrounding backlight blocks. Specifically, the backlight blocks provided with a demanded luminance value are the backlight blocks B2L, B3L, B1R, B5L, B6L, B4R, B8L, B9L, and B7R.

Figure 29:
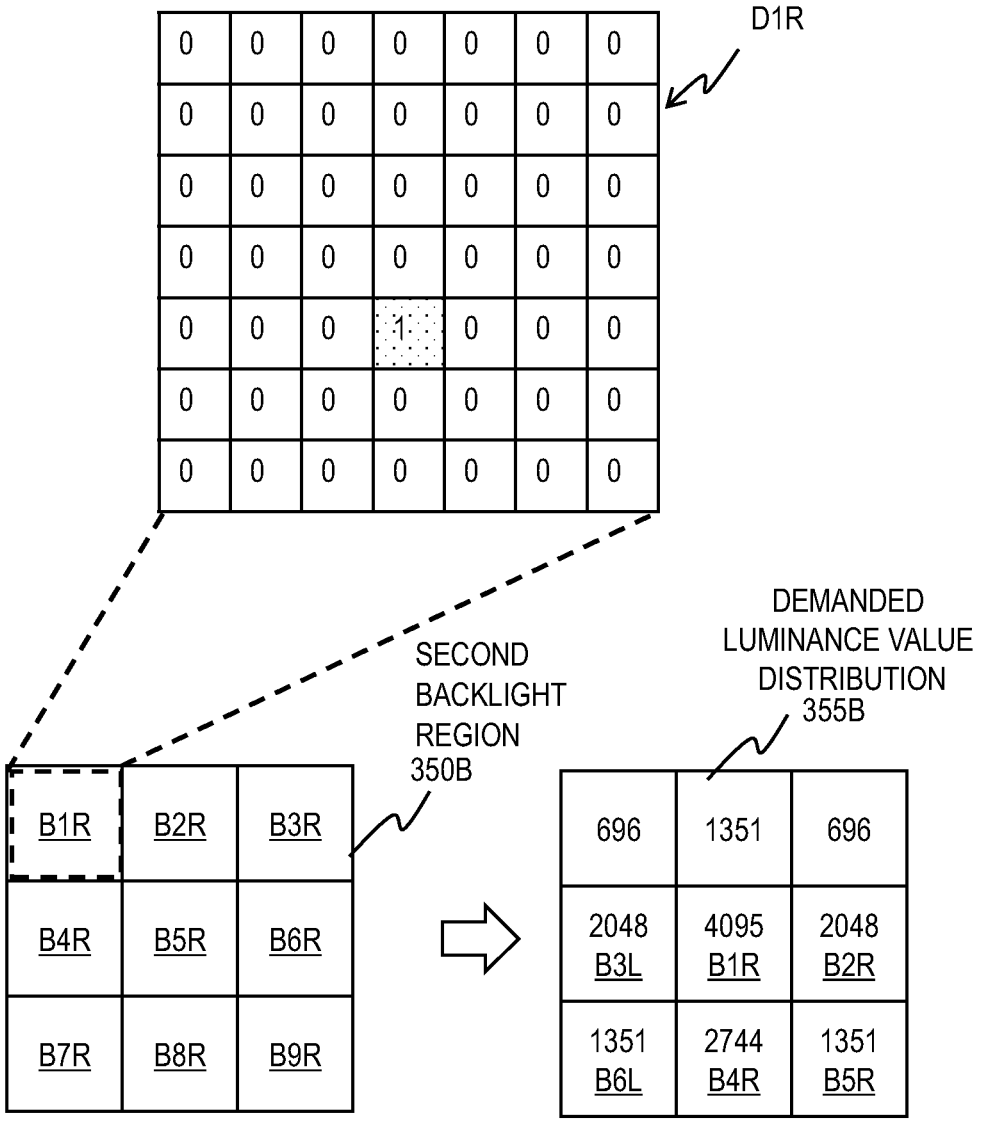
FIG. 29 provides a demanded luminance value distribution from a second display region opposite to a second backlight region.

FIG. 29 provides a demanded luminance value distribution from the second display region 250B opposite to the second backlight region 350B. In this example, only the display region block D1R opposite to the backlight block B1R includes a value to be lit. In the display region block D1R, only one pixel is assigned the maximum luminance value of 1 and the other pixels are assigned a luminance value of 0.

The demanded luminance value distribution 355B from the display region block D1R indicates the backlight blocks provided with a demanded luminance value and demanded luminance values expressed by a 12-bit resolution. The demanded luminance values are for the backlight block B1R and its surrounding backlight blocks. Specifically, the backlight blocks provided with a demanded luminance value are the backlight blocks B3L, B1R, B2R, B6L, B4R, and B5R.

Figure 30:
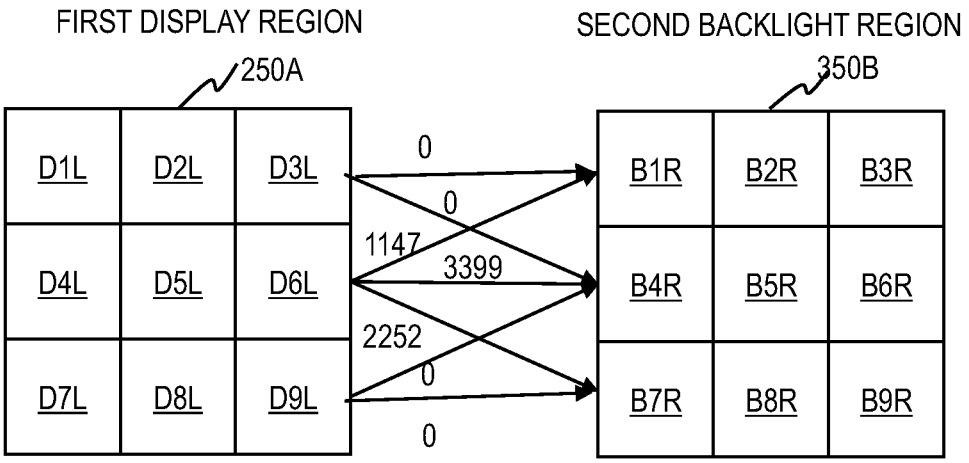
FIG. 30 provides luminance values demanded from the first display region to the second backlight region.

FIG. 30 provides luminance values demanded from the first display region 250A to the second backlight region 350B. The first display region 250A consists of display region blocks D1L to D9L. The display region blocks D1L to D9L are associated with the backlight blocks B1L to B9L correspondingly. The demanded luminance values from the display region blocks D3L, D6L, and D9L adjacent to the second display region 250B are provided to the second backlight region 350B.

As described with reference to FIG. 28, only the display region block D6L includes a pixel to light. Accordingly, the luminance values demanded from the display region block D3L to the backlight blocks B1R and B4R are 0. The luminance values demanded from the display region block D9L to the backlight blocks B4R and B7R are also 0. The luminance values demanded from the display region block D6L to the backlight blocks B1R, B4R, and B7R are 1147, 3399, and 2252, respectively.

Figure 31:
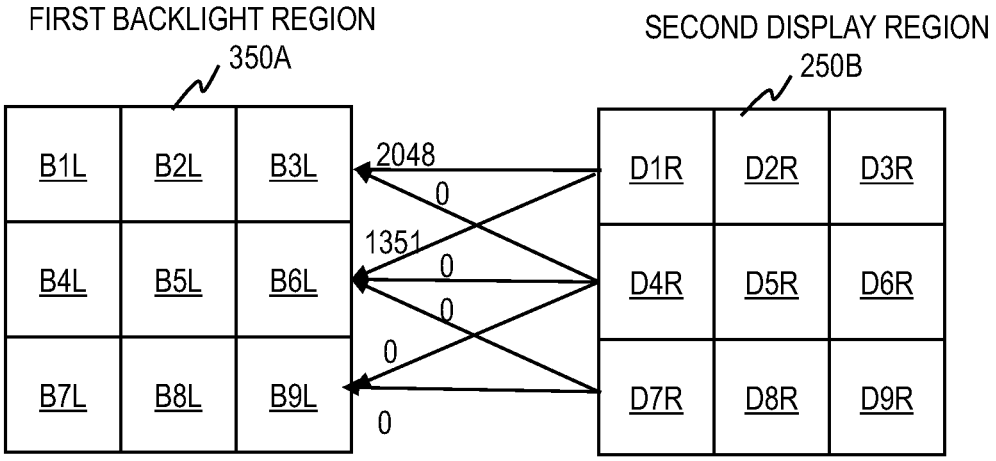
FIG. 31 provides luminance values demanded from the second display region to the first backlight region.

FIG. 31 provides luminance values demanded from the second display region 250B to the first backlight region 350A. The second display region 250B consists of display region blocks D1R to D9R. The display region blocks D1R to D9R are associated with the backlight blocks B1R to B9R correspondingly. The demanded luminance values from the display region blocks D1R, D4R, and D7R adjacent to the first display region 250A are provided to the first backlight region 350A.

As described with reference to FIG. 29, only the display region block D1R includes a pixel to light. Accordingly, the luminance values demanded from the display region block D4R to the backlight blocks B3L, B6L, and B9L are 0. The luminance values demanded from the display region block D7R to the backlight blocks B6L and B9L are also 0. The luminance values demanded from the display region block D1R to the backlight blocks B3L and B6L are 2048 and 1351, respectively.

Figures 32, 33:
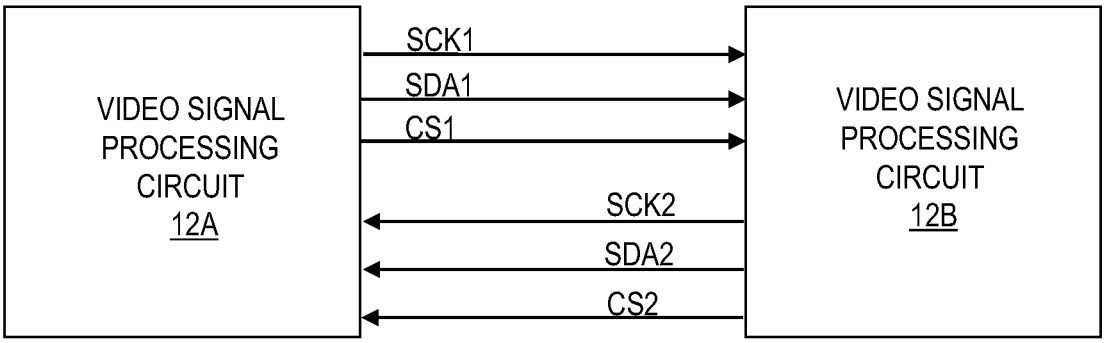
FIG. 32 provides a definitive distribution of luminance values for the backlight blocks.
FIG. 33 illustrates examples of data to be communicated between video signal processing circuits.

FIG. 32 provides a definitive distribution of luminance values for the backlight blocks. The video signal processing circuits 12A and 12B determine the highest demanded luminance value for each backlight block to be the luminance value for the backlight block. In the first backlight region 350A, the backlight block B3L is assigned a luminance value in accordance with the demanded luminance value from the adjacent second display region 250B. In the second backlight region 350B, the backlight blocks B4R and B7R are assigned luminance values in accordance with the demanded values from the adjacent first display region 250A.

As understood from the above, one video signal processing circuit acquires information on demanded luminance values of display region blocks from the other video signal processing circuit to control the luminance values of the backlight blocks of its own territory. As a result, luminance change at the boundary between two display regions can be prevented.

FIG. 33 illustrates examples of data to be communicated between the video signal processing circuits 12A and 12B. The video signal processing circuit 12A sends a data signal SDA1 specifying demanded luminance values to the video signal processing circuit 12B using a clock signal SCK1 and a control signal CS1. The video signal processing circuit 12B sends a data signal SDA2 specifying demanded luminance values to the video signal processing circuit 12A using a clock signal SCK2 and a control signal CS2. The signal transmission lines can be reduced by sharing one or more of the signal lines between the video signal processing circuits 12A and 12B.

Figure 34:
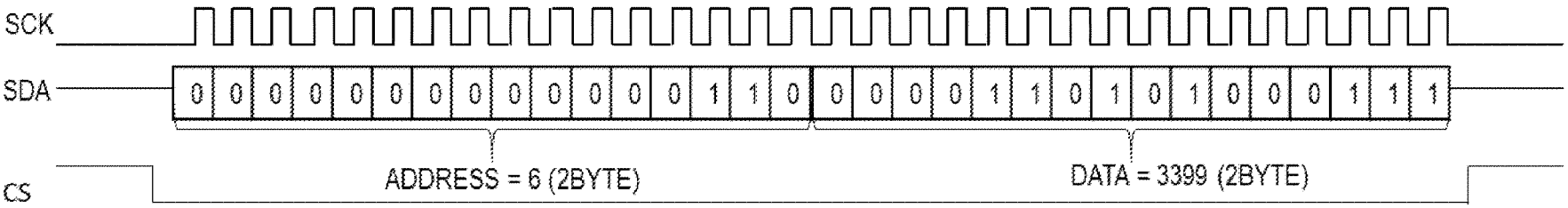
FIG. 34 illustrates examples of waveforms of a clock signal, a data signal, and a control signal.

FIG. 34 illustrates examples of waveforms of the clock signal SCK, the data signal SDA, and the control signal CS. The data signal SDA indicates the address of the display region block providing a demanded luminance value and a demanded luminance value. In the example of FIG. 34, the address is 6 and the demanded luminance value is 3399; they are specified in 16 bits. The video signal processing circuit can send the address of the source display region block and its two or three demanded luminance values successively.

In the foregoing example, each of the display region and the backlight region is divided into two regions and the divided regions are controlled by two video signal processing circuits. In another example, the number of regions divided from the display region and the backlight region and the number of video signal processing circuits can be three or more. Information on demanded luminance values is communicated between the video signal processing circuits controlling adjoining display regions and the backlight regions therefor.

As set forth above, embodiments of this disclosure have been described; however, this disclosure is not limited to the foregoing embodiments. Those skilled in the art can easily modify, add, or convert each element in the foregoing embodiments within the scope of this disclosure. A part of the configuration of one embodiment can be replaced with a configuration of another embodiment or a configuration of an embodiment can be incorporated into a configuration of another embodiment.

What is claimed is:

1. A method of controlling a backlight of a display device including a display panel and the backlight, the backlight including a plurality of backlight blocks, the display panel including display region blocks opposite to the plurality of backlight blocks in one-to-one correspondence, the method comprising:

for each backlight block of the plurality of backlight blocks:

determining a demanded luminance value demanded from each of a plurality of pixels in a plurality of display region blocks including a display region block opposite to the backlight block and one or more display region blocks adjacent to the opposite display region block to the backlight block, the demanded luminance value being determined based on a pixel luminance value of the pixel and a weight determined depending on a relation of a location of the pixel and a location of the backlight block; and determining a highest value among the demanded luminance values for the backlight block to be a backlight luminance value for the backlight block, wherein, as a bright spot having a highest pixel luminance value moves pixel by pixel within a first display region block opposite to a first backlight block toward a second display region block adjacent to the first display region block and opposite to a second backlight block adjacent to the first backlight block, the demanded luminance value demanded from the bright spot for the second backlight block increases, wherein, when the bright spot reaches an edge of the first display region block adjacent to the second display region block, the demanded luminance values demanded from the bright spot for the first and second backlight blocks become the same, and the demanded luminance value demanded from the bright spot for a third backlight block, which is adjacent to the first backlight block on an opposite side of the second backlight block, becomes zero, and wherein, when the bright spot moves from the edge of the first display region block to an edge of the second display region block, the demanded luminance values from the bright spot for the first and second backlight blocks remain the same.

2. The method according to claim 1, wherein the weight is defined as a decreasing function with respect to a distance between the pixel and the backlight block.

3. The method according to claim 1, wherein the plurality of display region blocks include all display region blocks sharing a boundary with the opposite display region block.

4. The method according to claim 1, wherein the plurality of backlight blocks are disposed in a matrix, and wherein the plurality of display region blocks include display region blocks adjacent along a row, adjacent along a column, and adjacent diagonally to the opposite display region block.

5. The method according to claim 1, further comprising:

determining a highest value among demanded luminance values demanded from all pixels in the plurality of display region blocks including the opposite display region block and the display region blocks adjacent to the opposite display region block to the backlight block to be the backlight luminance value for the backlight block.

6. The method according to claim 1, further comprising, for each of the display region blocks:

determining demanded luminance values demanded from the display region block to a backlight block opposite to the display region block and backlight blocks adjacent to the opposite backlight block, wherein the demanded luminance value demanded from the display region block to the opposite backlight block is determined based on a highest pixel luminance value among pixel luminance values for pixels in the display region block, wherein the demanded luminance value demanded from the display region block for each of the backlight blocks other than the opposite backlight block is a highest demanded luminance value among demanded luminance values determined based on pixel luminance values for pixels and weights according to locations of the pixels within the display region block, and wherein the backlight luminance value for each of the plurality of backlight blocks is determined to be a highest demanded luminance value among the demanded luminance values demanded from the display region blocks to the backlight block.

7. A display device comprising:

a display panel;

a backlight disposed behind the display panel, the backlight including a plurality of backlight blocks; and a controller configured to control luminance values for the plurality of backlight blocks and light emitted from the backlight and transmitted through the display panel, wherein the controller is configured to perform on each backlight block of the plurality of backlight blocks:

determining a demanded luminance value demanded from each of a plurality of pixels in a plurality of display region blocks including a display region block opposite to the backlight block and one or more display region blocks adjacent to the opposite display region block to the backlight block, the demanded luminance value being determined based on a pixel luminance value of the pixel and a weight determined depending on a relation of a location of the pixel and a location of the backlight block; and determining a highest value among the demanded luminance values for the backlight block to be a backlight luminance value for the backlight block, wherein, as a bright spot having a highest pixel luminance value moves pixel by pixel within a first display region block opposite to a first backlight block toward a second display region block adjacent to the first display region block and opposite to a second backlight block adjacent to the first backlight block, the demanded luminance value demanded from the bright spot for the second backlight block increases, wherein, when the bright spot reaches an edge of the first display region block adjacent to the second display region block, the demanded luminance values demanded from the bright spot for the first and second backlight blocks become the same, and the demanded luminance value demanded from the bright spot for a third backlight block, which is adjacent to the first backlight block on an opposite side of the second backlight block, becomes zero, and wherein, when the bright spot moves from the edge of the first display region block to an edge of the second display region block, the demanded luminance values from the bright spot for the first and second backlight blocks remain the same.

8. The display device according to claim 7, wherein the controller includes:

a first processing circuit configured to control a first display region of the display panel and first backlight blocks opposite to the first display region; and a second processing circuit configured to control a second display region of the display panel and second backlight blocks opposite to the second display region, wherein the first processing circuit is configured to acquire demanded luminance values from a display region block in the second display region and control the first backlight blocks based on the acquired demanded luminance values and demanded luminance values from display region blocks in the first display region, and wherein the second processing circuit is configured to acquire demanded luminance values from a display region block in the first display region and control the second backlight blocks based on the acquired demanded luminance values and demanded luminance values from display region blocks in the second display region.

* * * * *